US009174447B2

(12) United States Patent
Sugahara

(10) Patent No.: US 9,174,447 B2
(45) Date of Patent: Nov. 3, 2015

(54) LIQUID EJECTING DEVICE FACILITATING REPLACEMENT OF CARTRIDGE

(71) Applicant: Brother Kogyo Kabushiki Kaisha, Nagoya-shi, Aichi-ken (JP)

(72) Inventor: Hiroto Sugahara, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/636,451

(22) Filed: Mar. 3, 2015

(65) Prior Publication Data

US 2015/0251427 A1 Sep. 10, 2015

(30) Foreign Application Priority Data

Mar. 4, 2014 (JP) ..... 2014-041197

(51) Int. Cl.
*B41J 2/165* (2006.01)

(52) U.S. Cl.
CPC ..... *B41J 2/16505* (2013.01)

(58) Field of Classification Search
CPC ..... B41J 2/16505
USPC ..... 347/37, 108, 29; 400/54
See application file for complete search history.

(56) References Cited

U.S. PATENT DOCUMENTS

| | | | | |
|---|---|---|---|---|
| 5,020,926 | A * | 6/1991 | Wilhelm | 400/54 |
| 6,328,415 | B1 * | 12/2001 | Norton et al. | 347/37 |
| 6,942,333 | B2 * | 9/2005 | Ju et al. | 347/108 |
| 8,500,241 | B2 | 8/2013 | Yazawa | |
| 2011/0242209 | A1 | 10/2011 | Yazawa | |

FOREIGN PATENT DOCUMENTS

| | | | |
|---|---|---|---|
| JP | 2002-036597 | A | 2/2002 |
| JP | 2004-114363 | A | 4/2004 |
| JP | 2007-069541 | A | 3/2007 |
| JP | 2011-212977 | A | 10/2011 |

* cited by examiner

*Primary Examiner* — Julian Huffman
*Assistant Examiner* — Carlos A Martinez
(74) *Attorney, Agent, or Firm* — Banner & Witcoff, Ltd.

(57) ABSTRACT

A liquid ejecting device includes a casing, a carriage, and a cartridge. The carriage is configured to move in a first direction and a second direction. The cartridge is configured to be removably mounted on the carriage and includes a first cartridge and a second cartridge. The first cartridge has a first grip part. The second cartridge has a second grip part. The carriage is configured to move between a first position where the first grip part is exposed and positioned outside the casing through a first opening and a second position where the second grip part is exposed and positioned outside the casing through a second opening.

18 Claims, 13 Drawing Sheets

LIQUID EJECTING DEVICE FACILITATING REPLACEMENT OF CARTRIDGE

CROSS REFERENCE TO RELATED APPLICATION

This application claims priority from Japanese Patent Application No. 2014-041197 filed Mar. 4, 2014. The entire content of this priority application is incorporated herein by reference.

TECHNICAL FIELD

The present invention relates to a liquid ejecting device in which cartridges are mounted on a carriage.

BACKGROUND

There is known in the art an on-carriage type inkjet recording device having a recording head and ink cartridges mounted on a carriage. One such inkjet recording device includes ink cartridges that can be replaced through an opening formed in a lateral side surface of the device casing. The inkjet recording device having this configuration facilitates the replacement of ink cartridges and enables space in the casing to be used more efficiently.

SUMMARY

However, in the known inkjet recording device described above, a plurality of the ink cartridges is mounted on the carriage so as to be arranged closely together in the front-rear direction (paper-conveying direction). This arrangement may make it difficult for a user to grip a desired ink cartridge during replacement operations.

In view of the foregoing, it is an object of the present invention to provide a liquid-ejecting device that facilitates replacement of a cartridge mounted on a carriage.

In order to at least attain the above object, the present invention provides a liquid ejecting device. The liquid ejecting device may include a casing, a carriage, a cartridge, and a flowing part. The casing may include a first wall formed with a first opening and at least part of a second wall formed with a second opening. At least part of the first wall may be opposite to at least part of the second wall. The casing may define a first direction extending from the second wall to the first wall and a second direction opposite to the first direction. The carriage may be configured to move in the first direction and the second direction in the casing. The cartridge may be configured to be removably mounted on the carriage and include a first cartridge having a first storage chamber accommodating liquid therein and a second cartridge having a second storage chamber configured to accommodate liquid therein. The flowing part may be configured to be mounted on the carriage in a state where the cartridge is mounted on the carriage. The flowing part may include a first flowing part configured to flow liquid between at least one first distal opening exposed from the carriage and a first proximal opening in communication with the first storage chamber and a second flowing part configured to flow liquid between at least one second distal opening exposed from the carriage and a second proximal opening in communication with the second storage chamber. The flowing part may be configured to allow the liquid to pass through the at least one first distal opening and the at least one second distal opening in a third direction. The first cartridge may have a first mounting part at least partially overlapped with at least one first distal opening and/or the at least one second distal opening as viewed from the third direction and a first grip part offset from the at least one first distal opening and the at least one second distal opening in the first direction as viewed from the third direction, when the first cartridge is mounted on the carriage. The second cartridge may have a second mounting part at least partially overlapped with the at least one first distal opening and/or the at least one second distal opening as viewed from the third direction and a second grip part offset from the at least one first distal opening and the at least one second distal opening in the second direction as viewed from the third direction, when the second cartridge is mounted on the carriage The carriage may be configured to move between a first position where the first grip part is exposed and positioned outside the casing through the first opening and a second position where the second grip part is exposed and positioned outside the casing through the second opening.

According to another aspect, the present invention provides a liquid ejecting device. The liquid ejecting device may include a casing, a carriage, and a cartridge. The casing may include a first wall formed with a first opening and a second wall formed with a second opening. At least part of the first wall may be opposite to at least part of the second wall. The casing may define a first direction extending from the second wall to the first wall and a second direction opposite to at least part of the first direction. The carriage may be configured to move in the first direction and the second direction within the casing. The cartridge may be configured to be removably mounted on the carriage and include a first cartridge accommodating liquid therein and a second cartridge configured to accommodate liquid therein. The first cartridge may have a first grip part and the second cartridge has a second grip part. The carriage may be configured to move between a first position and a second position. The first grip part may be exposed and positioned outside the casing through the first opening and the second grip part may be positioned inside the casing when the first cartridge and the second cartridge are mounted on the carriage at the first position. The second grip part may be exposed and positioned outside the casing through the second opening and the first grip part may be positioned inside the casing when the first cartridge and the second cartridge are mounted on the carriage at the second position.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, a preferred embodiment of the present invention will be described. Note that the embodiment described below is merely an example of the invention and may be modified in many ways without departing from the spirit of the invention, the scope of which is defined by the attached claims. In the following description, an top-bottom direction 7 is defined for an inkjet recording device 100 when the inkjet recording device 100 is oriented in a usable state (the state in FIG. 1A); a front-rear direction 8 is defined based on the side of the inkjet recording device 100 in which a discharge opening 13A is formed serving as the near side (front surface); and a left-right direction 9 is defined based on the perspective of a user facing the near side (front surface) of the inkjet recording device 100. Further, an upward direction and a downward direction are both components of the top-bottom direction 7; a forward direction and a rearward direction are both components of the front-rear direction 8; and a leftward direction and rightward direction are both components of the left-right direction 9.

[Inkjet Recording Device]

Figure 1A:
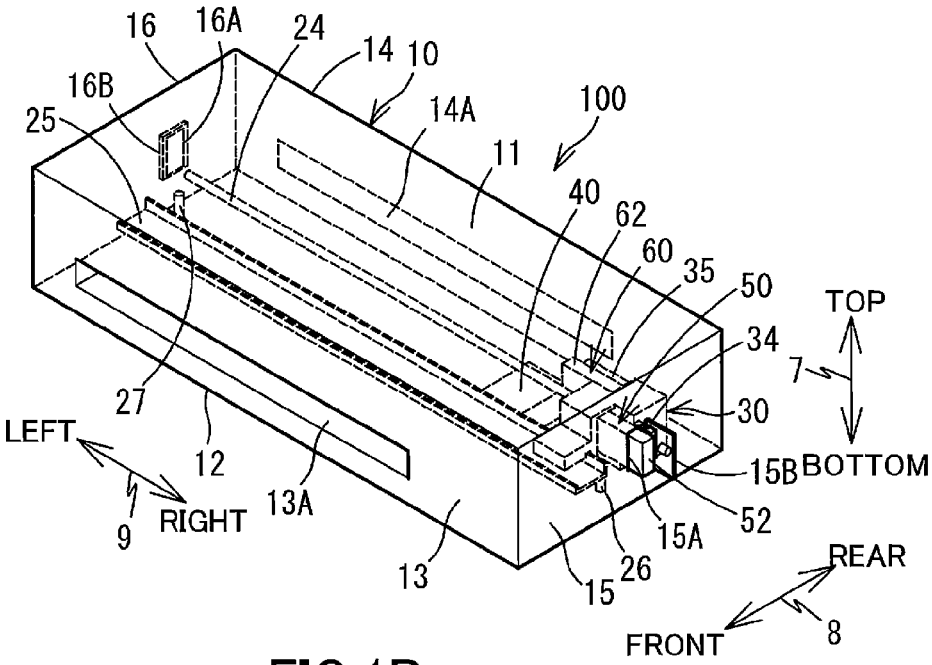
FIG. 1A is a forward perspective view of an inkjet recording device according to an embodiment of the invention.
Figure 1B:
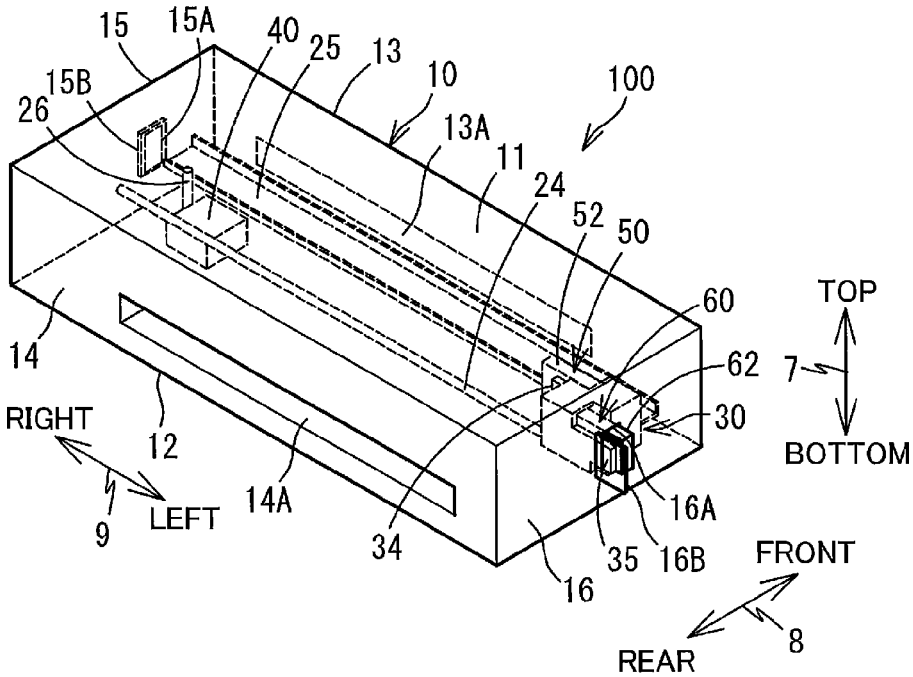
FIG. 1B is a rearward perspective view of the inkjet recording device according to the embodiment of the invention.
Figure 2:
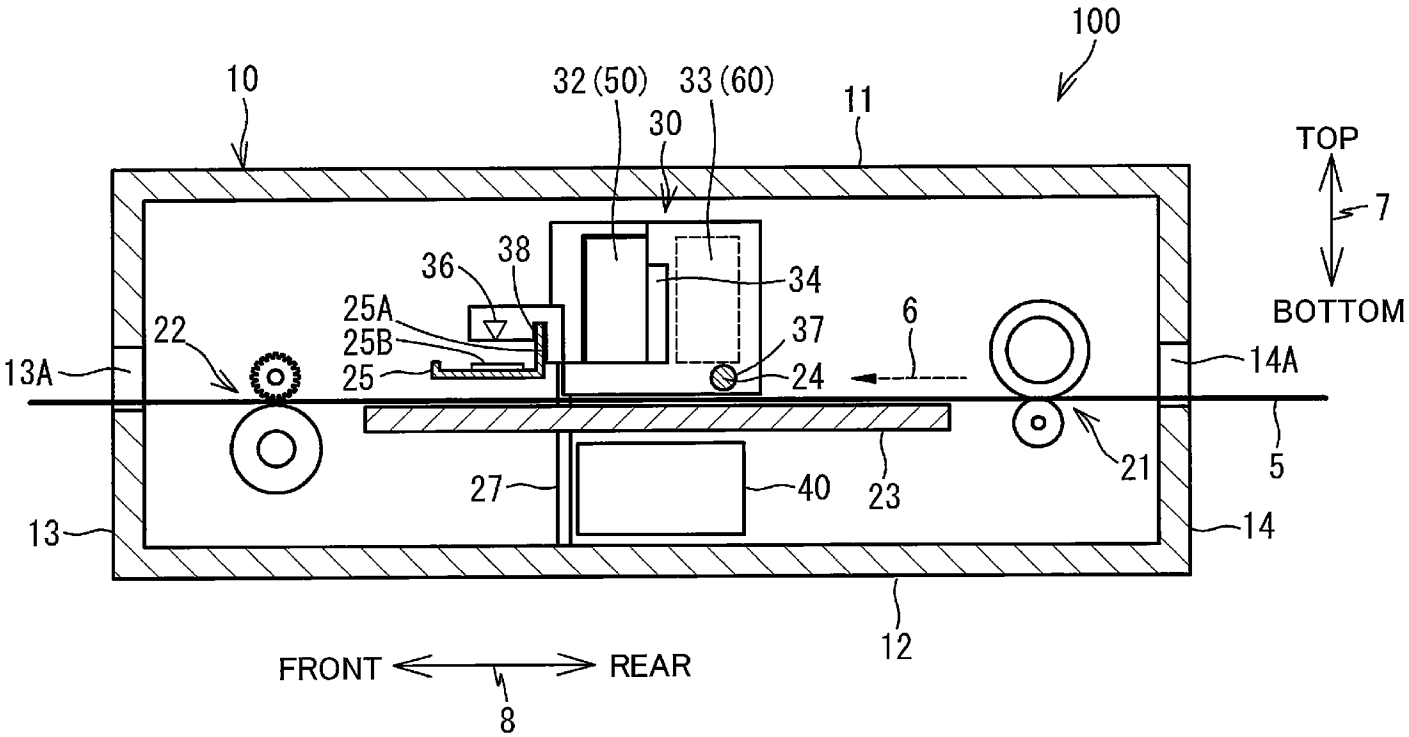
FIG. 2 is a vertical cross-sectional view of the inkjet recording device according to the embodiment of the invention.
Figure 3:
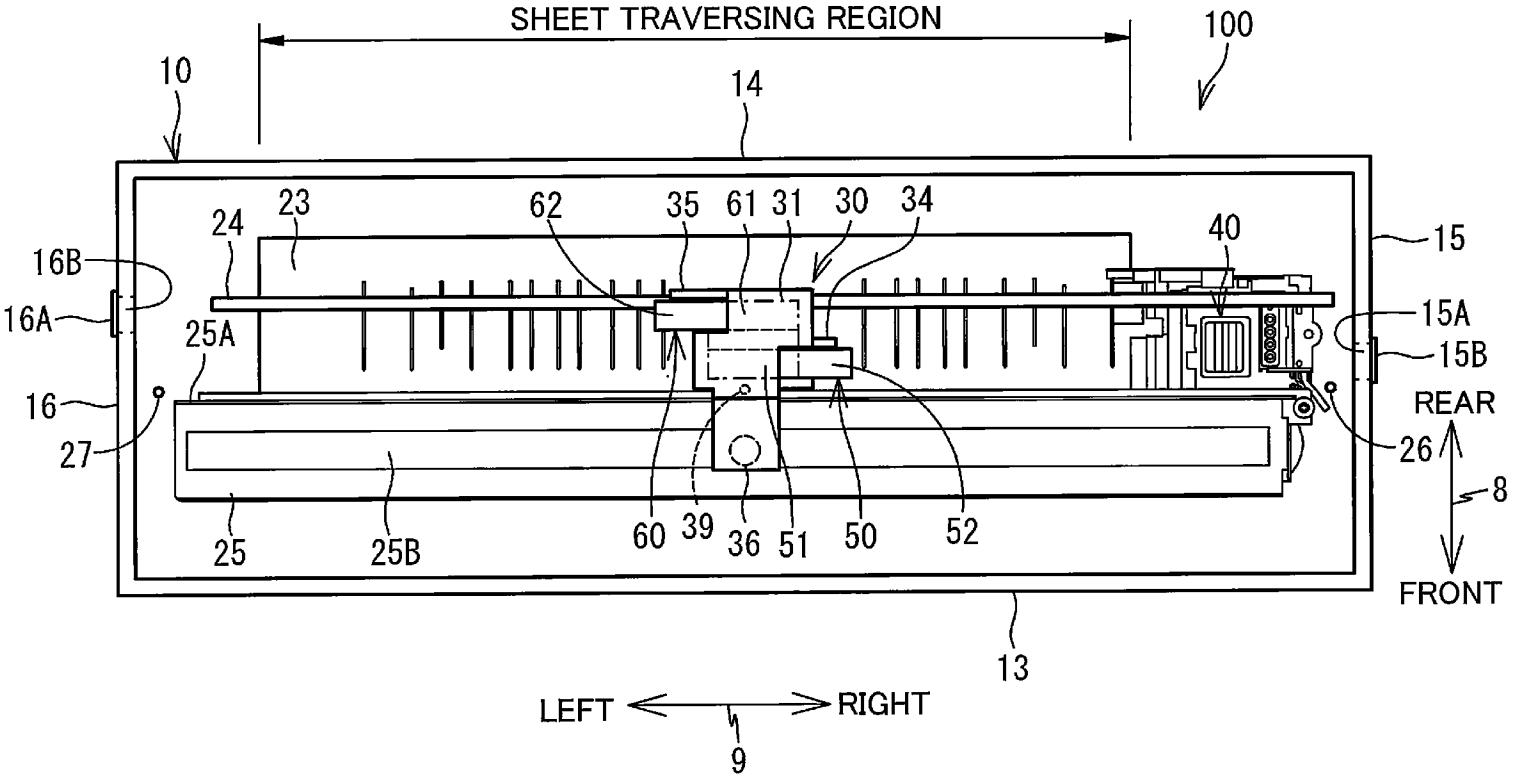
FIG. 3 is an internal plan view of the inkjet recording device according to the embodiment of the invention.

FIGS. 1 through 3 show the inkjet recording device 100 (an example of the liquid ejecting device) according to a preferred embodiment of the present invention. The inkjet recording device 100 includes a casing 10, a pair of conveying rollers 21, a pair of discharge rollers 22, a platen 23, a guide shaft 24, a guide rail 25, fixing pins 26 and 27, a carriage 30, a maintenance mechanism 40, cartridges 50 and 60, and a controller 130 (see FIG. 7). The inkjet recording device 100 records images on a recording sheet 5 (see FIG. 2) by ejecting ink stored in the cartridges 50 and 60. Further, the inkjet recording device 100 is an on-carriage type inkjet printer in which the cartridges 50 and 60 are mounted on the carriage 30.

[Casing]

As shown in FIGS. 1A and 1B, the casing 10 is box-shaped with space formed in the interior thereof. Within this internal space, the casing 10 supports the conveying rollers 21, the discharge rollers 22, the platen 23, the guide shaft 24, the guide rail 25, the fixing pins 26 and 27, the carriage 30, the maintenance mechanism 40, and the like. As shown in FIGS. 1A and 1B, the casing 10 has a general rectangular parallelepiped shape having a top wall 11, a bottom wall 12, a front wall 13, a rear wall 14, a right wall 15 (an example of the first wall), and a left wall 16 (an example of the second wall). At least part of the top wall 11 is positioned opposite to at least part of the bottom wall 12 in the top-bottom direction 7. That is, at least part of the top wall 11 is overlapped with at least part of the bottom wall 12 as viewed from the top-bottom direction 7. At least part of the front wall 13 is positioned opposite to at least part of the rear wall 14 in the front-rear direction 8. That is, at least part of the front wall 13 is overlapped with at least part of the rear wall 14 as viewed from the front-rear direction 8. At least part of the right wall 15 is positioned opposite to at least part of the left wall 16 in the left-right direction 9. That is, at least part of the right wall 15 is overlapped with at least part of the left wall 16 as viewed from the left-right direction 9.

The rear wall 14 is formed with an insertion opening 14A through which a recording sheet 5 is inserted into the casing 10 for an image to be recorded. The front wall 13 is formed with the discharge opening 13A through which a recording sheet 5 is discharged from the casing 10 after an image has been recorded thereon. The right wall 15 is formed with an opening 15A (an example of the first opening) through which the cartridge 50 can pass. The left wall 16 is formed with an opening 16A (an example of the second opening) through which the cartridge 60 can pass. The openings 15A and 16A are offset from each other in the front-rear direction 8.

Figure 9A:
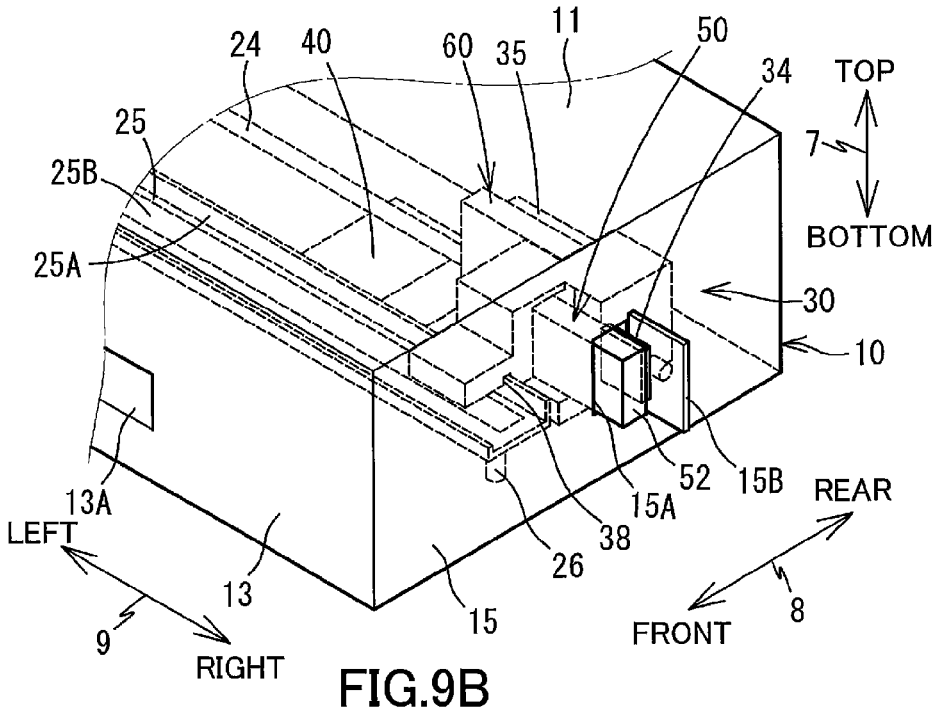
FIG. 9A is a partial perspective view of the inkjet recording device wherein the carriage is at a first position according to the embodiment of the invention.

Further, the right wall 15 is provided with a cover 15B (an example of the first cover) configured to move between a first closed position at which the cover 15B covers the opening 15A and the opening 15A is closed (see FIG. 9B), and a first open position at which the cover 15B does not cover the opening 15A and the opening 15A is opened (see FIG. 9A). Similarly, the left wall 16 is provided with a cover 16B (an example of the second cover) configured to move between a second closed position at which the cover 16B covers the opening 16A and the opening 16A is closed, and a second open position at which the cover 16B does not cover the opening 16A and the opening 16A is opened. The cover 15B and the cover 16B move between the first and second closed positions and the first and the second open positions respectively by rotating about a rotational shaft (not shown) extending in the top-bottom direction 7 at their respective rear edges. Torsion coil springs or other urging members (not shown) are respectively provided for urging the corresponding covers 15B and 16B toward the first and second closed positions.

[Conveying Rollers and Discharge Rollers]

As shown in FIG. 2, the conveying rollers 21 pinch the recording sheet 5 inserted into the casing 10 through the insertion opening 14A and convey the recording sheet 5 in a conveying direction 6 (the forward direction, i.e., direction from the rear side of the inkjet recording device 100 toward the front side in the preferred embodiment) so that the recording sheet 5 passes between the carriage 30 and the platen 23. The discharge rollers 22 grip the recording sheet 5 conveyed from the conveying rollers 21 and convey the recording sheet 5 in the conveying direction 6, discharging the recording sheet 5 from the casing 10 through the discharge opening 13A. The conveying rollers 21 are disposed upstream (rearward in the preferred embodiment) of the carriage 30 in the conveying direction 6, and the discharge rollers 22 are disposed downstream (forward in the preferred embodiment) of the carriage 30 in the conveying direction 6. The conveying rollers 21 and the discharge rollers 22 are driven to rotate by a drive force transmitted from a conveying motor 101 (see FIG. 7).

[Platen]

As shown in FIG. 2, the platen 23 is disposed between the conveying rollers 21 and the discharge rollers 22 in the front-rear direction 8 and at a position facing the carriage 30 in the top-bottom direction 7. The platen 23 supports the recording sheet 5 from below as the recording sheet 5 is conveyed by the conveying rollers 21 and the discharge rollers 22.

[Guide Shaft and Guide Rail]

As shown in FIG. 3, the guide shaft 24 and the guide rail 25 are elongated in the left-right direction 9 and separated from each other in the front-rear direction 8. The guide shaft 24 is inserted through an insertion opening 37 (described later) formed through the carriage 30 on the upstream side of the guide rail 25 in the conveying direction 6. The guide rail 25 supports part of the carriage 30 from below on the downstream side of the guide shaft 24 in the conveying direction 6. The guide rail 25 has a top surface provided with a protruding rib 25A fitted into a groove 38 (described later) formed in the carriage 30, and an encoder strip 25B elongated in the left-right direction 9.

[Fixing Pins]

The fixing pin 26 (an example of the first restricting part) extends upward toward the carriage 30 at a position facing the carriage 30 when the carriage 30 is at a first position shown in FIG. 1A. That is, the fixing pin 26 is disposed on one end (the right end) of the moving range of the carriage 30. The fixing pin 27 (an example of the second restricting part) extends upward toward the carriage 30 at a position facing the carriage 30 when the carriage 30 is at a second position shown in FIG. 1B. That is, the fixing pin 27 is disposed on the other end (the left end) of the moving range of the carriage 30.

Figure 7:
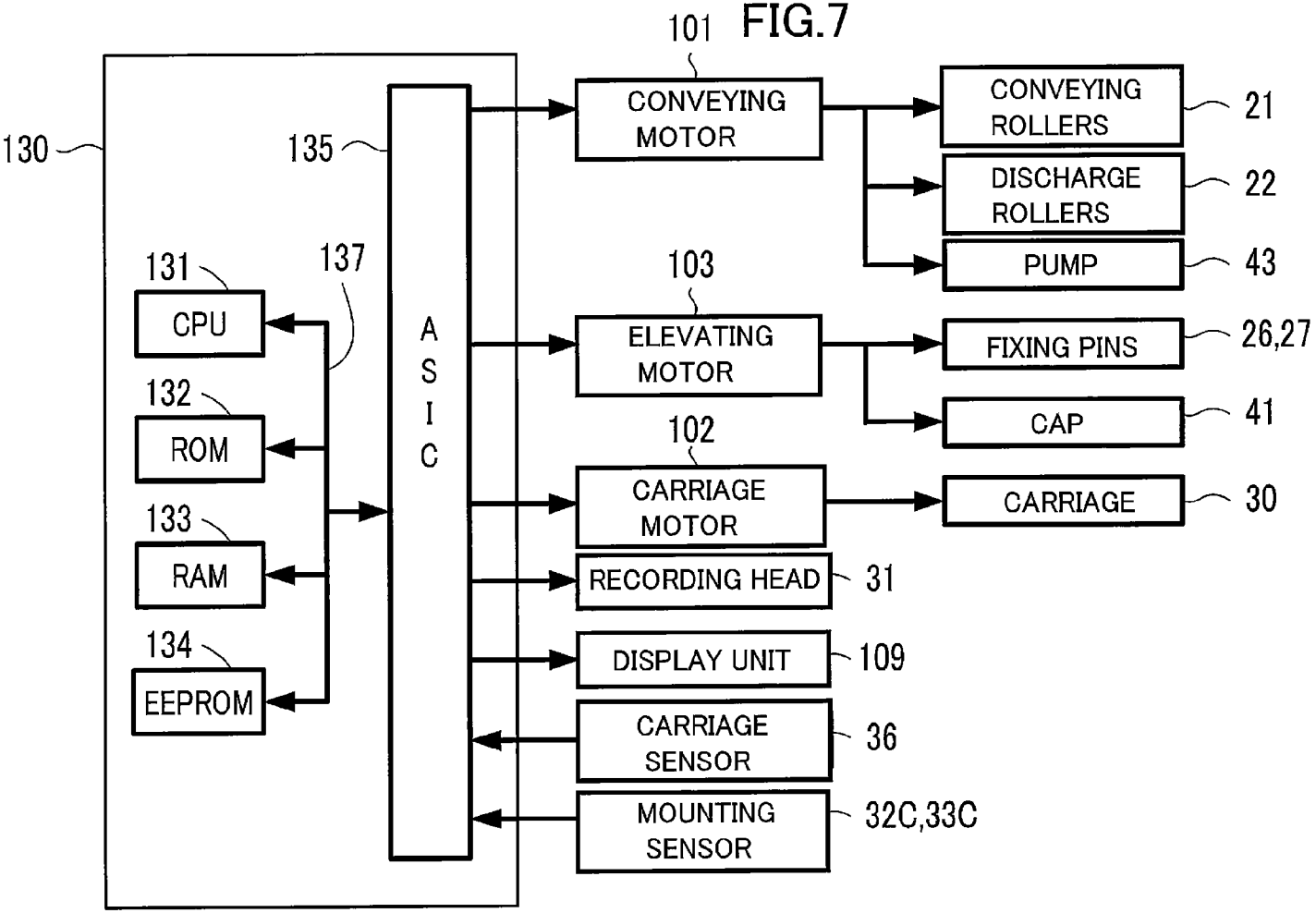
FIG. 7 is a block diagram of the inkjet recording device according to the embodiment of the invention.

The fixing pins 26 and 27 are configured to move in the top-bottom direction 7 (i.e., rise and fall) in response to the drive force transmitted from an elevating motor 103 (see FIG. 7). When the carriage 30 is at the first position and the fixing pin 26 is moved upward, the fixing pin 26 advances into a recessed part 39 (described later; see FIG. 5) formed in the bottom surface of the carriage 30 and restricts the movement of the carriage 30 (particularly leftward movement). When the carriage 30 is at the second position and the fixing pin 27 is moved upward, the fixing pin 27 advances into the recessed part 39 and restricts movement of the carriage 30 (particularly rightward movement). When moved downward, the fixing pins 26 and 27 separate from the carriage 30.

[Carriage]

As shown in FIG. 2, the carriage 30 is disposed between the conveying rollers 21 and the discharge rollers 22 in the front-rear direction 8 at a position facing the platen 23 in the top-bottom direction 7. As shown in FIGS. 3 through 5, the carriage 30 includes a recording head 31, mounting units 32 and 33, contact parts 34 and 35, a carriage sensor 36, the insertion opening 37, the groove 38, and the recessed part 39.

Figure 4A:
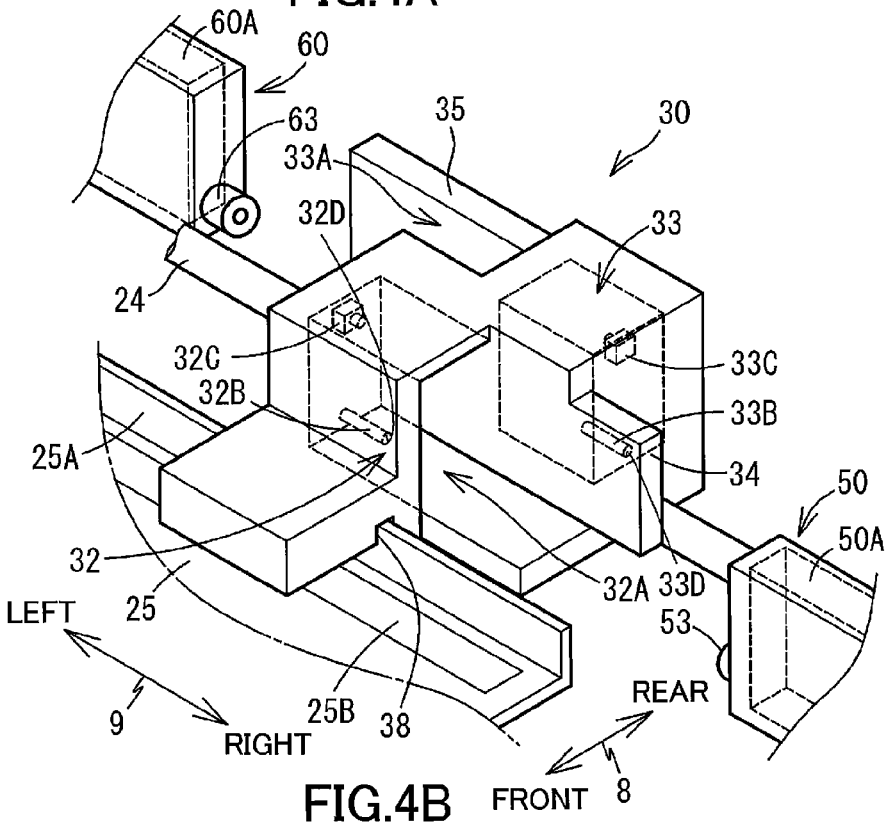
FIG. 4A is an upper perspective view of a carriage wherein cartridges are separated from mounting units of the carriage according to the embodiment of the invention.
Figure 4B:
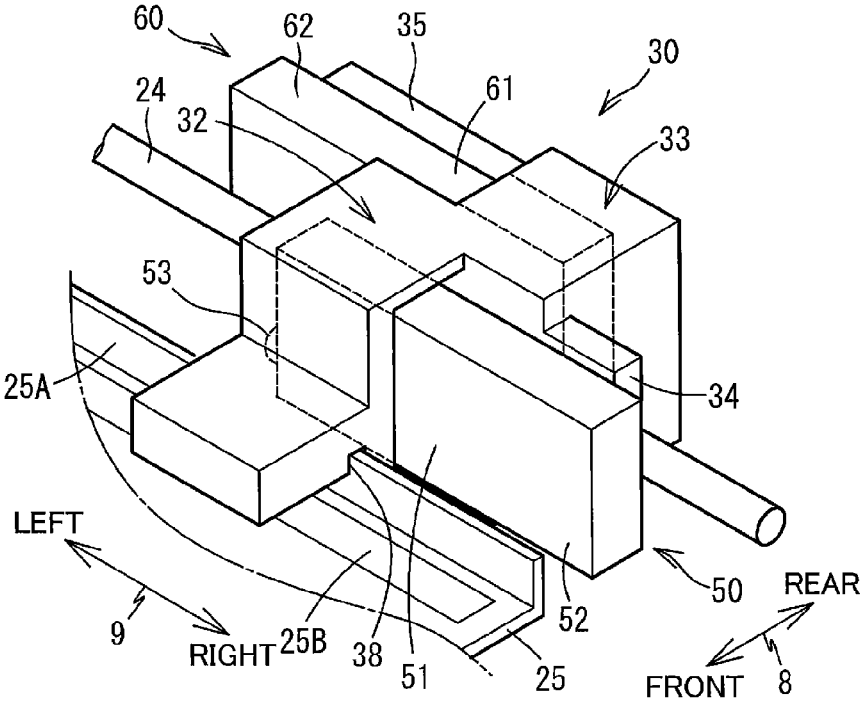
FIG. 4B is an upper perspective view of the carriage wherein the cartridges are mounted on the mounting units according to the embodiment of the invention.
Figure 5A:
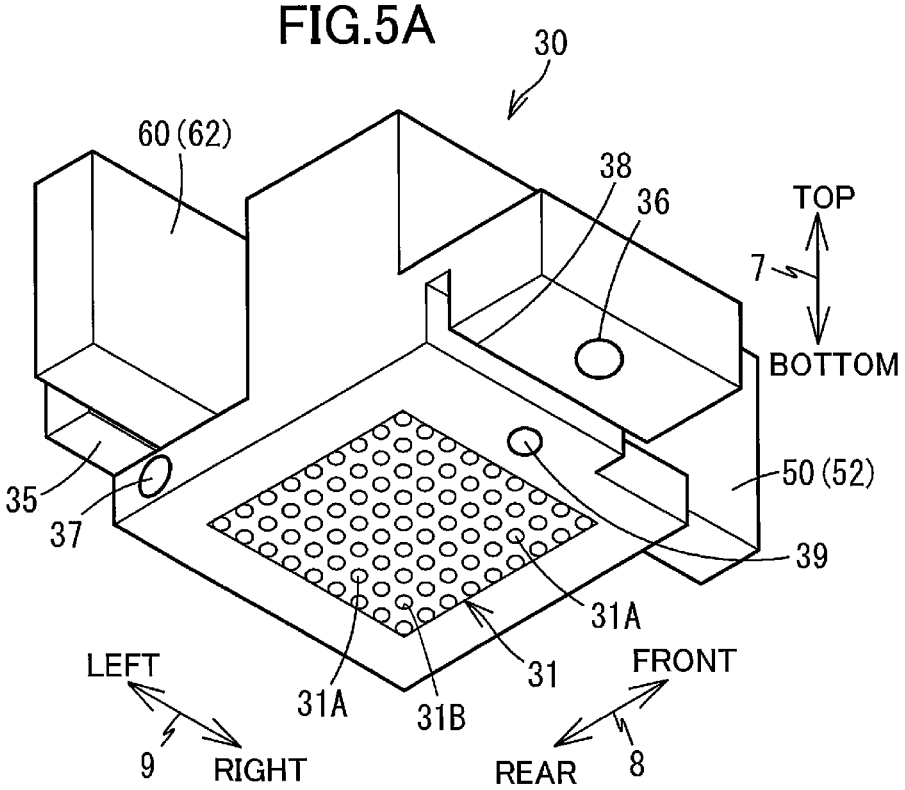
FIG. 5A is a lower perspective view of the carriage according to the embodiment of the invention.
Figure 5B:
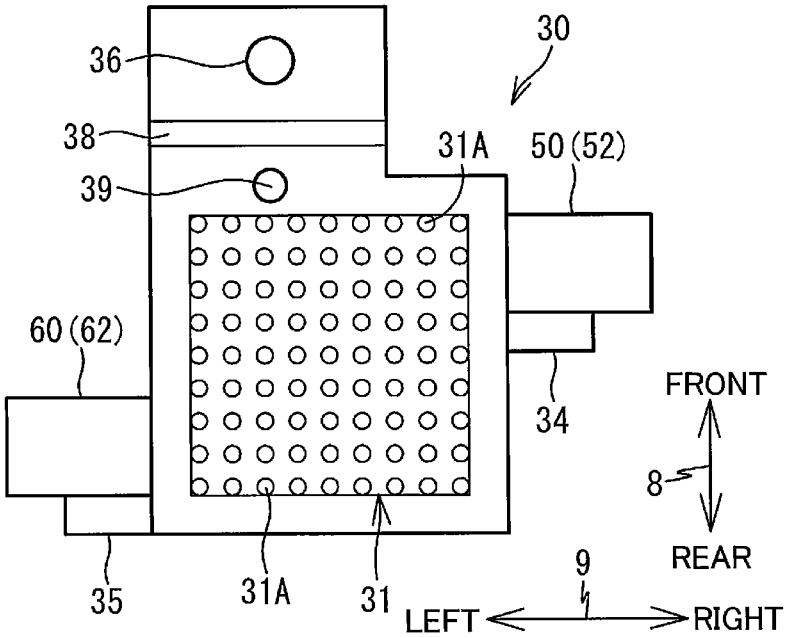
FIG. 5B is a bottom view of the carriage according to the embodiment of the invention.

As shown in FIGS. 4A and 4B, the position of the carriage 30 in the top-bottom direction 7 and the front-rear direction 8 are determined by inserting the guide shaft 24 into the insertion opening 37 and by fitting the protruding rib 25A in the groove 38. Further, the carriage 30 can move rightward from the left wall 16 side toward the right wall 15 side (an example of the first direction) and leftward from the right wall 15 side toward the left wall 16 side (an example of the second direction) by a drive force transmitted from a carriage motor 102 (see FIG. 7). Movement of the carriage 30 in the left-right direction 9 is restricted when the fixing pin 26 or the fixing pin 27 advances into the recessed part 39 when the carriage 30 is at the corresponding first position or second position.

[Recording Head]

As shown in FIG. 5, the recording head 31 is mounted on the carriage 30. As the carriage 30 moves over a sheet-traversing region (FIG. 3), the recording head 31 ejects ink onto the recording sheet 5 conveyed by the conveying rollers 21 and the discharge rollers 22, thereby recording an image on the recording sheet 5. The recording head 31 has a plurality of nozzles 31A whose distal openings 31B are exposed from the bottom surface of the carriage 30, as shown in FIG. 5. The nozzles 31A have first nozzles and second nozzles, and correspondingly the distal openings 31B have first distal openings and second distal openings. The nozzles 31A are in communication with space formed in ink needles 32B and 33B (described later) through the inner space of the recording head 31. More specifically, the first nozzles of the nozzles 31A and the first distal openings of the distal openings 31B are in communication with the inner space of the ink needle 32B, and the second nozzles of the nozzles 31A and the second distal openings of the distal openings 31B are in communication with the inner space of the ink needle 33B. The recording head 31 draws in ink (an example of the liquid) from storage chambers 50A and 60A (described later) through the respective ink needles 32B and 33B and ejects the ink from the distal openings 31B. The direction in which ink is ejected from the distal openings 31B (downward in the top-bottom direction 7 in the preferred embodiment) is an example of the third direction.

[Mounting Units]

As shown in FIGS. 4A and 4B, the mounting units 32 and 33 are respectively formed with openings 32A and 33A for mounting the corresponding cartridges 50 and 60. Specifically, the cartridge 50 is inserted leftward into the mounting unit 32 through the opening 32A and removed rightward from the mounting unit 32 through the opening 32A. Similarly, the cartridge 60 is inserted rightward into the mounting unit 33 through the opening 33A and removed leftward from the mounting unit 33 through the opening 33A.

The ink needle 32B is provided at a left end surface of the mounting unit 32 and protrudes toward the opening 32A (i.e., rightward). Similarly, the ink needle 33B is provided at a right end surface of the mounting unit 33 and protrudes toward the opening 33A (i.e., leftward). Each of the ink needles 32B and 33B is a cylindrical tube formed of resin and has an inner space/channel formed therein. The ink needle 32B has a protruding end formed with a first proximal opening 32D, and the ink needle 33B has a protruding end formed with a second proximal opening 33D. The first proximal opening 32D and the second proximal opening 33D may be formed through a side wall adjacent to the corresponding protruding end, and the protruding end may be closed. The ink needles 32B and 33B provide communication between the recording head 31 and the corresponding cartridges 50 and 60 when inserted into respective ink delivery parts 53 and 63 (described later) of the corresponding cartridges 50 and 60 mounted to the corresponding mounting units 32 and 33.

In other words, ink stored in the storage chambers 50A and 60A (described later) of the corresponding cartridges 50 and 60 mounted to the mounting units 32 and 33 is supplied through the first and second proximal openings 32D and 33D, through the inner space/channel of the corresponding ink needles 32B and 33B, and through the inner space of the recording head 31, and is ejected from the distal openings 31B. The recording head 31 and the ink needles 32B and 33B are examples of the flowing part for flowing ink between the distal openings 31B of the nozzles 31A exposed from the carriage 30 and the first and second proximal openings 32D and 33D of the ink needles 32B and 33B in fluid communication with the storage chambers 50A and 60A. More specifically, an example of the first flowing part is formed between the first distal openings of the distal openings 31B and the first proximal opening 32D in communication with the storage chamber 50A, and an example of the second flowing part is formed between the second distal openings of the distal openings 31B and the second proximal opening 33D in communication with the storage chamber 60A.

Further, mounting sensors 32C and 33C (example of the mounting/removing detection unit) are respectively provided in the mounting units 32 and 33. The mounting sensors 32C and 33C output mounting/removing signals to the controller 130 based on whether the cartridges 50 and 60 are mounted to or removed from the corresponding mounting units 32 and 33.

[Cartridge]

As shown in FIGS. 4A and 4B, the cartridges 50 and 60 are box-like members having substantially a rectangular parallelepiped shape. The storage chambers 50A and 60A are respectively formed in the cartridges 50 and 60 for storing ink therein. In the preferred embodiment, the storage chamber 50A of the cartridge 50 (an example of the first cartridge) stores ink of a first color, and the storage chamber 60A of the cartridge 60 (an example of the second cartridge) stores ink of a second color different from a first color. The cartridge 50 includes a mounting part 51 (an example of the first mounting part), a grip part 52 (an example of the first grip part), and the ink delivery part 53. The cartridge 60 similarly includes a mounting part 61 (an example of the second mounting part), a grip part 62 (an example of the second grip part), and the ink delivery part 63.

When the cartridge 50 is mounted on the carriage 30 (i.e., on the mounting unit 32), the mounting part 51 partially and vertically overlaps the first distal openings and the second distal openings of the distal openings 31B, or the first distal openings or the second distal openings of the distal openings 31B in a plan view as viewed from the top-bottom direction 7. In other words, the mounting part 51 partially and vertically overlaps the recording head 31 in a plan view as viewed from the top-bottom direction. On the other hand, the grip part 52 protrudes rightward from the first distal openings and the second distal openings of the distal openings 31B in a plan view, i.e., the grip part 52 is offset from the first distal openings and the second distal openings of the distal openings 31B in the rightward direction, as shown in FIGS. 4 and 5. Hence, the mounting part 51 is positioned to the left of the grip part 52 when the cartridge 50 is mounted on the mounting unit 32, i.e., the mounting part 51 is positioned between the grip part 52 and the left wall 16. Similarly, when the cartridge 60 is mounted on the carriage 30 (i.e., on the mounting unit 33), the mounting part 61 partially and vertically overlaps the first distal openings and the second distal openings of the distal openings 31B, or the first distal openings or the second distal openings of the distal openings 31B in a plan view as viewed from the top-bottom direction 7. In other words, the mounting part 61 partially and vertically overlaps the recording head 31 in a plan view as viewed from the top-bottom direction 7. On the other hand, the grip part 62 protrudes leftward from the distal openings 31B in a plan view, i.e., the grip part 62 is offset from the distal openings 31B in the leftward direction. Hence, the mounting part 61 is positioned to the right of the grip part 62 when the cartridge 60 is mounted on the mounting unit 33, i.e., the mounting part 61 is positioned between the grip part 62 and the right wall 15.

Note that the mounting part 51 and the grip part 52 are defined by their positional relationships relative to the carriage 30 when the cartridge 50 is mounted on the carriage 30. Therefore, it is not necessary to have a concise or apparent boundary between the mounting part 51 and the grip part 52 when the cartridge 50 is not mounted on the carriage 30. The same is true with respect to the mounting part 61 and the grip part 62.

Further, the cartridges 50 and 60 are mounted on the carriage 30 at positions offset in both the front-rear direction 8 and the left-right direction 9. As viewed in either the forward or rearward direction (an example of the fourth direction) of the front-rear direction 8, at least part of the mounting part 51 overlaps at least part of the mounting part 61 when the cartridges 50 and 60 are mounted on the carriage 30. Further, when the carriage 30 is placed at the first position shown in FIG. 1A, the grip part 52 is exposed and positioned outside the casing 10 through the opening 15A, while the grip part 62 is positioned inside the casing 10. Conversely, when the carriage 30 is placed at the second position shown in FIG. 1B, the grip part 52 is positioned inside the casing 10 and the grip part 62 is exposed and positioned outside the casing 10 through the opening 16A. Moreover, when the cartridges 50 and 60 are mounted on the carriage 30, the grip part 52 is offset from the grip part 62 in the rightward direction and is not overlapped with the grip part 62 as viewed in either the frontward or rearward direction of the front-rear direction 8.

[Contact Parts]

As shown in FIGS. 4A and 4B, the contact part 34 (an example of the first contact part) protrudes rightward from the right surface of the carriage 30 in a region adjacent to the mounting unit 32 in the front-rear direction 8. When the carriage 30 is placed at the first position shown in FIG. 1A, the contact part 34 is exposed and positioned outside the casing 10 through the opening 15A. That is, the contact part 34 contacts the cover 15B and moves the cover 15B into the first open position so that the contact part 34 is exposed and positioned outside the casing 10. Similarly, the contact part 35 (an example of the second contact part) protrudes leftward from the left surface of the carriage 30 in a region adjacent to the mounting unit 33 in the front-rear direction 8. When the carriage 30 is placed at the second position shown in FIG. 1B, the contact part 35 is exposed and positioned outside the casing 10 through the opening 16A. That is, the contact part 35 contacts the cover 16B and moves the cover 16B into the second open position so that the contact part 35 is exposed and positioned outside the casing 10.

[Carriage Sensor]

As shown in FIG. 2, the carriage sensor 36 is mounted on the bottom surface of the carriage 30 at a position facing the encoder strip 25B in the top-bottom direction 7. As the carriage 30 moves along the left-right direction 9, the carriage sensor 36 reads the encoder strip 25B, generates a pulse signal (an example of the position signal), and outputs this pulse signal to the controller 130 (see FIG. 7). The carriage sensor 36 is an example of the position detecting unit that outputs the position signal (i.e., the pulse signal) for identifying the position of the carriage 30.

[Maintenance Mechanism]

Figure 6:
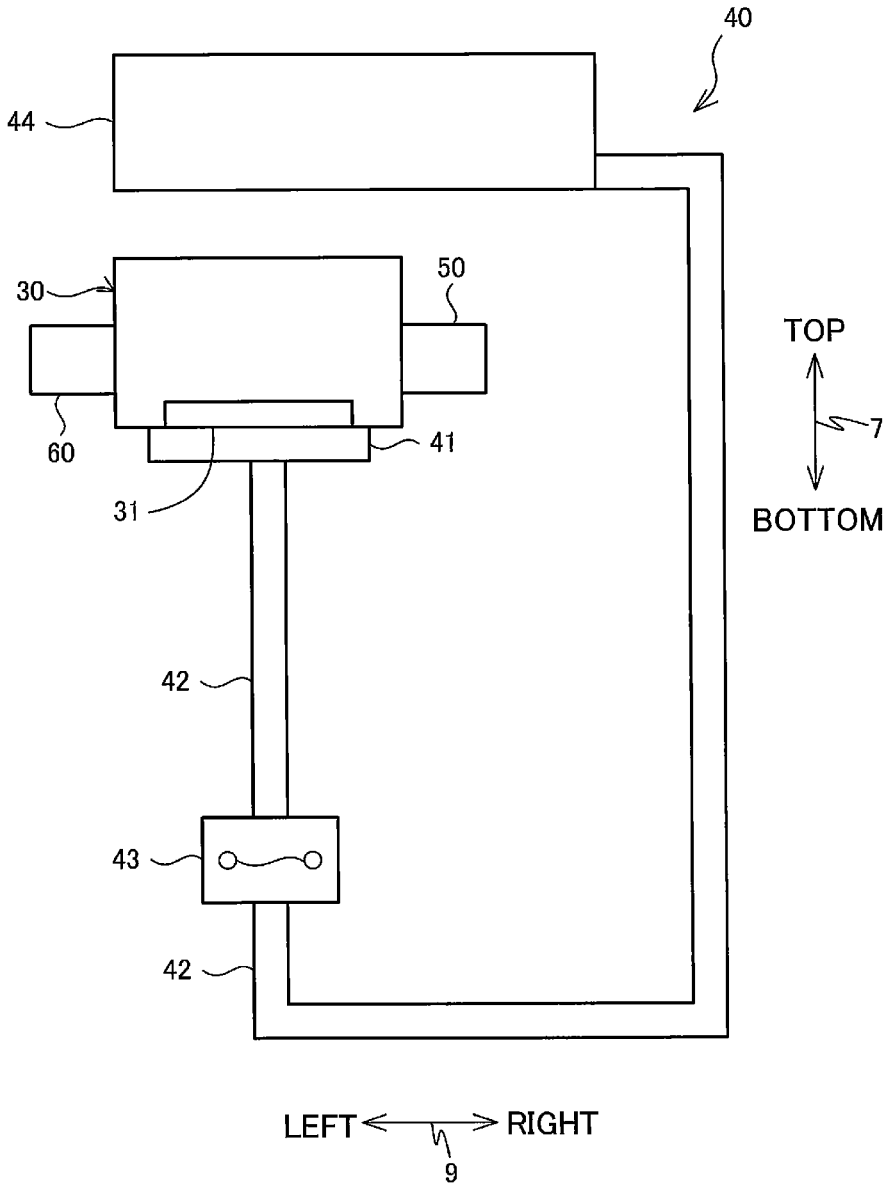
FIG. 6 is a schematic view of a maintenance mechanism according to the embodiment of the invention.
Figure 9B:
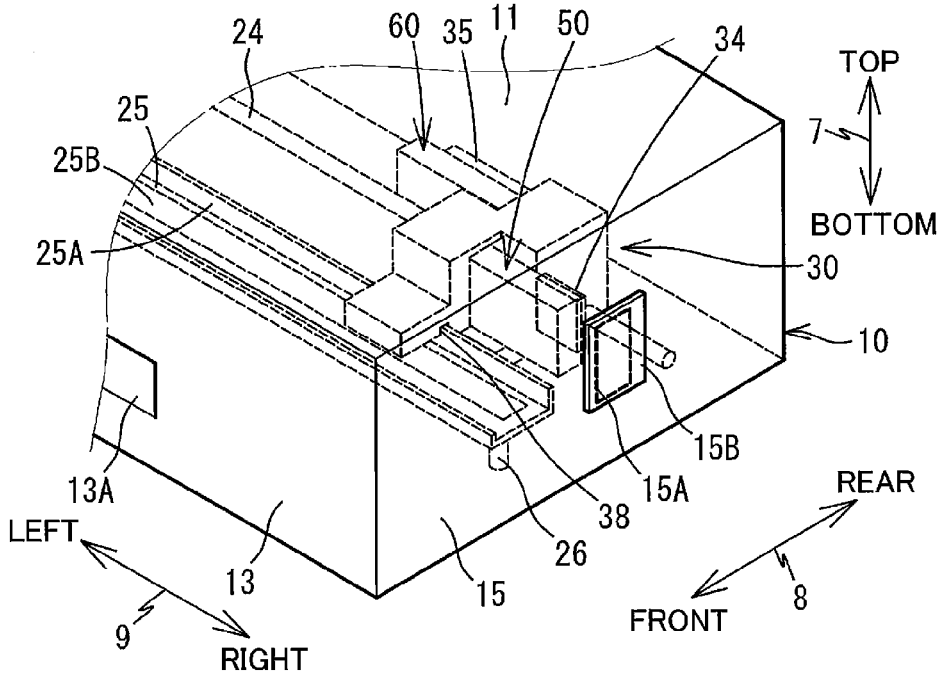
FIG. 9B is a partial perspective view of the inkjet recording device wherein the carriage is at a third position according to the embodiment of the invention.

As shown in FIGS. 1A and 1B, the maintenance mechanism 40 is positioned outside the region in which the recording sheet 5 passes (denoted the "sheet-traversing region" in FIG. 3) with respect to the left-right direction 9. More specifically, the maintenance mechanism 40 is arranged in a position facing the carriage 30 when the carriage 30 is at a third position different from the first and second positions (FIG. 9B). The maintenance mechanism 40 is configured to execute a process for removing by suction air bubbles and foreign matter together with ink from the nozzles 31A formed in the recording head 31 (known as a purging operation). As shown in FIG. 6, the maintenance mechanism 40 includes a cap 41, a tube 42, a pump 43, and a waste liquid tank 44.

The cap 41 moves in the top-bottom direction 7 (i.e., rises and falls) relative to the carriage 30 when the carriage 30 is at the third position by a drive force transmitted from the elevating motor 103. More specifically, the cap 41 can be moved between a covering position at which the cap 41 contacts the recording head 31 and liquid-tightly covers the distal openings 31B, and a separated position at which the cap 41 is separated from the recording head 31 and the distal openings 31B. The cap 41 is formed of rubber, for example. When at the covering position, the cap 41 contacts the recording head 31 around the distal openings 31B of all nozzles 31A exposed from the carriage 30, providing a hermetical seal between the cap 41 and the recording head 31 (i.e., distal openings 31B of all nozzles 31A). In the separated position, the cap 41 is separated from the recording head 31 such that a gap is formed between the cap 41 and the recording head 31 in the top-bottom direction 7.

The tube 42 has a first end connected to the cap 41 and a second end connected to the waste liquid tank 44. The pump 43 is provided at a midpoint along the tube 42. The pump 43 is a peristaltic tube pump, for example, and functions to generate a flow of ink from the first end of the tube 42 toward the second end of the tube 42 when a drive force is transmitted to the pump 43 from the conveying motor 101. Thus, when the pump 43 is driven while the cap 41 is at the covering position, ink is drawn out from the nozzles 31A through the tube 42 and is discharged into the waste liquid tank 44.

[Controller]

As shown in FIG. 7, the controller 130 includes a central processing unit 131 (CPU), a read only memory 132 (ROM), a random access memory 133 (RAM), an electrically erasable programmable read only memory 134 (EEPROM), and an application specific integrated circuit 135 (ASIC), which components are all interconnected by an internal bus 137. The ROM 132 stores programs and the like for controlling various operations performed by the CPU 131. The RAM 133 serves as a storage area for temporarily storing data, signals, and the like used by the CPU 131 in executing the above programs, or as a work area for data processing. The EEPROM 134 stores settings, flags, and other data that must be preserved when the power supply is turned off. All or some of the CPU 131, the ROM 132, the RAM 133, the EEPROM 134, and the ASIC 135 may be configured on a single IC chip or may be divided in a plurality of IC chips.

The controller 130 drives the conveying motor 101 through a drive circuit in order to rotate the conveying rollers 21 and the discharge rollers 22 and to drive the pump 43. The drive force of the conveying motor 101 is distributed to these components through a drive force transmission mechanism (not shown). The controller 130 also drives the elevating motor 103 through a drive circuit in order to raise and lower the fixing pins 26 and 27 and the cap 41. The drive force of the elevating motor 103 is distributed to these components through a drive force transmission mechanism (not shown). The controller 130 also drives the carriage motor 102 through a drive circuit in order to move the carriage 30 in the left-right direction 9, i.e., in both rightward and leftward directions. The controller 130 also controls the recording head 31 through a drive circuit to eject ink from the nozzles 31A. The controller 130 also displays information related to the inkjet recording device 100 and various messages on a display unit 109 through a display circuit.

The controller 130 determines whether or not the cartridges 50 and 60 are mounted on in the corresponding mounting units 32 and 33 based on the mounting/removing signals outputted from the mounting sensors 32C and 33C. For example, the controller 130 determines that the cartridge 50 is mounted on the mounting unit 32 if a high level signal is outputted from the mounting sensor 32C (where a high level signal is defined as "a signal that is more than or equal to a threshold level"). On the other hand, the controller 130 determines that the cartridge 50 is not mounted on the mounting unit 32 if a low level signal is outputted from the mounting sensor 32C (where a low level signal is defined as "a signal that is less than the threshold level"). The same is true with respect to the mounting sensor 33C.

The controller 130 also identifies the position of the carriage 30 based on the pulse signal outputted from the carriage sensor 36. For example, the controller 130 sets a count value to zero when the carriage 30 is at a reference position (the first position, for example), incrementing the count value by the number of pulse signals received as the carriage 30 moves away from the reference position and decrementing the count value by the number of pulse signals received as the carriage 30 approaches the reference position. Hence, the count value corresponds to the distance between the current position of the carriage 30 and the reference position thereof.

[Cartridge-Mounting Process]

Next, a cartridge-mounting process will be described with reference to FIGS. 8 and 9. The following description is an example of a process for removing a used cartridge 50 from the mounting unit 32 and mounting a new cartridge 50 to the mounting unit 32. The controller 130 initiates the cartridge-mounting process when a replacement command for replacing the cartridge 50 has been received from a user. The user can input a replacement command through an operating unit (not shown) provided on the surface of the casing 10, for example. The steps shown in FIG. 8 may be implemented by the CPU 131 based on a program that the CPU 131 reads from the ROM 132, or may be implemented by a hardware circuit, such as the ASIC 135, a field-programmable gate array (FPGA) or the like.

Figure 8:
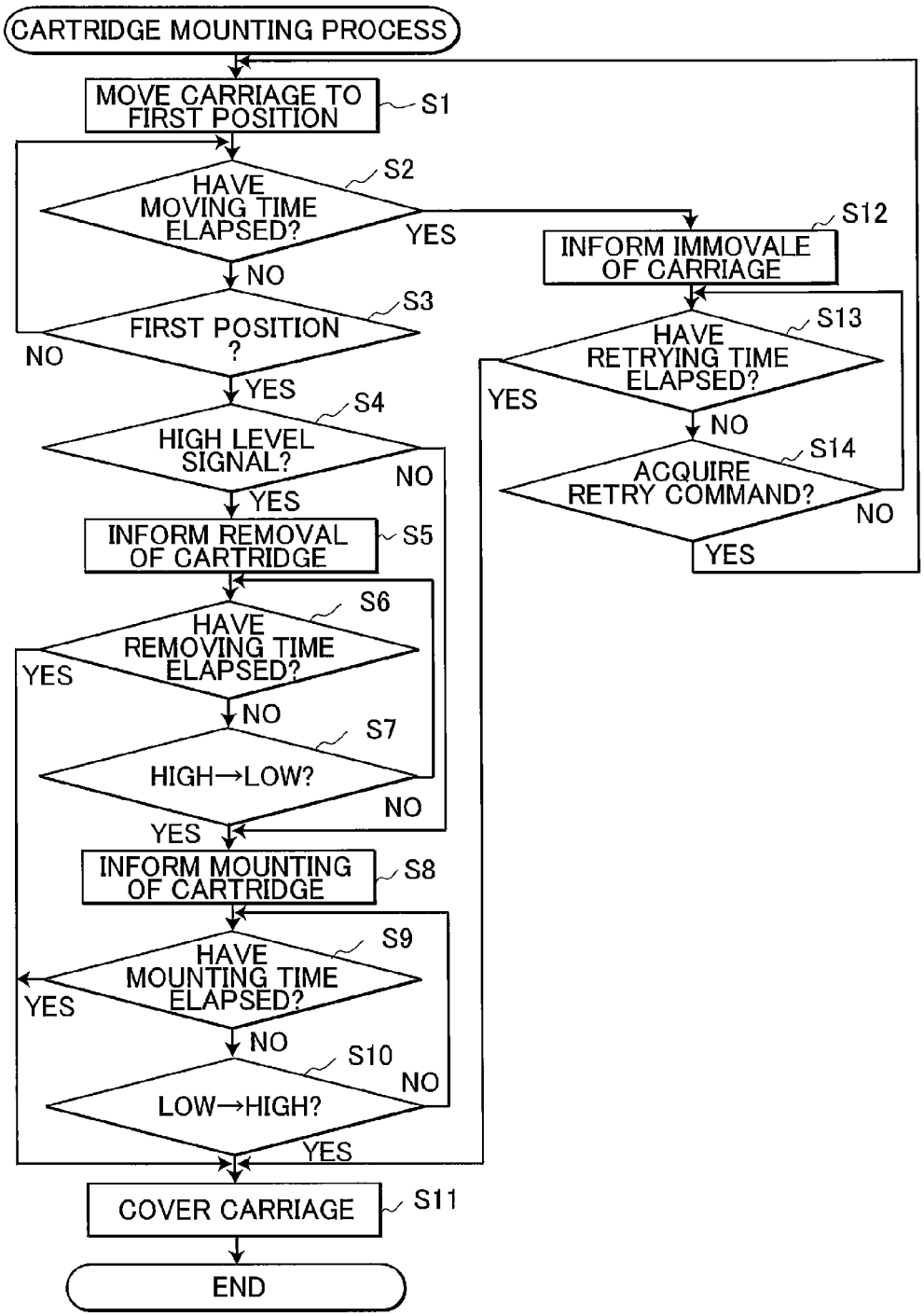
FIG. 8 is a flowchart illustrating a procedure of a cartridge mounting process according to the embodiment of the invention.

In S1 at the beginning of the process in FIG. 8, the controller 130 begins driving the carriage motor 102 to move the carriage 30 toward the first position. The process in step S1 is an example of the movement control process. Next, the controller 130 counts the pulse signals outputted from the carriage sensor 36 and in S2 determines whether a predefined moving time has elapsed since the controller 130 began driving the carriage motor 102. When the moving time has not elapsed (S2: NO), in S3 the controller 130 determines whether the carriage 30 has arrived at the first position. When the carriage 30 has moved into the first position, the cover 15B will have been contacted by the cartridge 50 and the contact part 34 and moved from the first closed position to the first open position shown in FIG. 9A, and the grip part 52 of the cartridge 50 and the contact part 34 will be protruding outside the casing 10 through the opening 15A.

If the carriage 30 arrives at the first position within the moving time (S2: NO, S3: YES), the controller 130 begins driving the elevating motor 103 to raise the fixing pin 26 until the fixing pin 26 has advanced into the recessed part 39. In S4 the controller 130 determines whether the high-level signal is being outputted from the mounting sensor 32C. If the high-level signal is being outputted from the mounting sensor 32C (S4: YES), in S5 the controller 130 prompts the user to remove the cartridge 50 from the mounting unit 32. Specifically, the controller 130 issues a notification to the user to grip the grip part 52 exposed through the opening 15A and to pull the cartridge 50 rightward from the mounting unit 32. Although there is no particular restriction on a specific method of notification, the controller 130 may display a message or animated graphic on the display unit 109 and may output voice instructions from a speaker (not shown).

In S6 the controller 130 determines whether a predefined removing time (an example of the mounting/removing time) has elapsed since the controller 130 prompted the user to remove the cartridge 50 based on the mounting/removing signal outputted from the mounting sensor 32C. When the removing time has not elapsed (S6: NO), in S7 the controller 130 continues to monitor the mounting/removing signal to determine whether the cartridge 50 has been removed from the mounting unit 32. That is, in S7 the controller 130 determines whether the mounting/removing signal outputted from the mounting sensor 32C has changed from the high-level signal (denoted by "High" in the drawing) to a low-level signal (denoted by "Low" in the drawing). If the mounting/removing signal changes from a high-level to the low-level signal within the removing time (S6: NO, S7: YES), in S8 the controller 130 prompts the user to mount a new cartridge 50 in the mounting unit 32. Specifically, the controller 130 issues a notification to the user informing the user to mount a new cartridge 50 into the mounting unit 32 through the opening 15A. The method of notification may be similar to that described for step S5.

In S9 the controller 130 determines whether a predefined mounting time (another example of the mounting/removing time) has elapsed since the controller 130 prompted the user to mount a new cartridge 50 based on the mounting/removing signal outputted from the mounting sensor 32C. When the mounting time has not elapsed (S9: NO), in S10 the controller 130 continues to monitor the mounting/removing signal outputted from the mounting sensor 32C to determine whether the mounting/removing signal has changed from the low-level signal to the high-level signal, indicating that a new cartridge 50 has been mounted to the mounting unit 32. If the mounting/removing signal outputted from the mounting sensor 32C has changed from the low-level signal to the high-level signal within the mounting time (S9: NO, S10: YES), then in S11 the controller 130 begins driving the elevating motor 103 and the carriage motor 102 to lower the fixing pin 26 to a position separated from the carriage 30, to move the carriage 30 into the third position shown in FIG. 9B, and to move the cap 41 to the covering position. As a result of this operation, the cover 15B is returned to the first closed position. The process in step S11 is an example of the capping process.

The controller 130 executes the capping process in step S11 if the mounting/removing signal outputted from the mounting sensor 32C has not changed from the high-level signal to the low-level signal within the removing time in S6 (i.e., if the cartridge 50 is not removed from the mounting unit 32; S6: YES) or if the mounting/removing signal outputted from the mounting sensor 32C has not changed from the low-level signal to the high-level signal within the mounting time in S9 (i.e., if the cartridge 50 is not mounted to the mounting unit 32; S9: YES).

Further, the controller 130 skips the processes in steps S5-S7 if the low-level signal is outputted from the mounting sensor 32C in S4 (i.e., if the cartridge 50 is not mounted on the mounting unit 32; S4: NO). Note that the low-level signal outputted from the mounting sensor 32C in S4 denotes that a cartridge 50 is not mounted on the mounting unit 32 at the beginning of the cartridge-mounting process. For example, this may occur when the cartridge-mounting process is executed after the capping process is performed because a new cartridge 50 is not mounted to the mounting unit 32 during the mounting time (S9: YES→S11).

Further, in S12 the controller 130 notifies the user that the carriage 30 cannot move if the carriage 30 has not arrived at the first position when the moving time has elapsed (S2: YES). Cases in which the carriage 30 does not arrive at the first position within the moving time may include a case in which the grip part 52 cannot pass through the opening 15A due to an obstruction immediately outside the opening 15A preventing the cover 15B from opening, and a case in which movement of the carriage 30 is hindered by an obstruction on the moving path of the carriage 30. The process in step S12 is an example of the notification process. The method of notification may be similar to that described in step S5.

Thereafter, the controller 130 determines in S13 whether a predefined retrying time has elapsed since the user is notified that the carriage 30 cannot move. When the retrying time has not elapsed (S13: NO), in S14 the controller 130 determines whether a retry command has been inputted by the user. If the controller 130 acquires the retry command within the retrying time (S13: NO, S14: YES), the controller 130 again executes the process from step S1. The retry command is a command to retry the process beginning from step S1 and is inputted by the user through the operating unit (not shown) after the user has removed the obstruction described above, for example. On the other hand, if the retry command has not been received within the retrying time (S13: YES), the controller 130 executes the capping process in S11.

While the above description covers the process of removing a used cartridge 50 from the mounting unit 32 and mounting a new cartridge 50 to the mounting unit 32, the process for removing a used cartridge 60 from the mounting unit 33 and mounting a new cartridge 60 to the mounting unit 33 is similarly performed. More specifically, the mounting process for the cartridge 60 can be better understood by replacing in the above description "first position" with "second position," "cartridge 50" with "cartridge 60," "grip part 52" with "grip part 62," "mounting unit 32" with "mounting unit 33," "contact part 34" with "contact part 35," "opening 15A" with "opening 16A," "cover 15B" with "cover 16B," "fixing pin 26" with "fixing pin 27," "mounting sensor 32C" with "mounting sensor 33C," and "rightward" with "leftward."

[Operational Advantages of the Embodiment]

In the preferred embodiment described above, the grip part 52 of the cartridge 50 and the grip part 62 of the cartridge 60 are offset in opposite directions from the distal openings 31B of the nozzles 31A in a plan view. Accordingly, when the carriage 30 is at the first position, the grip part 52 is exposed and positioned on the outside of the casing 10 through the opening 15A, while the grip part 62 is positioned inside the casing 10. With this arrangement, the neighboring cartridge 60 does not interfere with a user when the user grips the grip part 52, facilitating replacement of the cartridge 50. This description also applies to the replacement of the cartridge 60 on the mounting unit 33. Further, the grip parts 52 and 62 may overlap other components of the carriage 30 (the contact parts 34 and 35, for example) in the top-bottom direction 7, provided that the grip parts 52 and 62 are offset from the distal openings 31B in a plan view. Further, the openings 15A and 16A may be formed in any pair of walls that are at least partially opposite to each other and need not be formed in the right wall 15 and the left wall 16.

When mounted on the carriage 30, the cartridges 50 and 60 according to the embodiment described above are arranged so that the mounting parts 51 and 61 overlap in the front-rear direction 8, i.e., as viewed from either the forward direction or the rearward direction. This arrangement makes it possible to reduce the total dimension of the cartridges 50 and 60 in the left-right direction 9 when the cartridges 50 and 60 are mounted on the carriage 30. That is, this arrangement can reduce the overall length of the carriage 30 on which the cartridges 50 and 60 are mounted. As a result, a more compact inkjet recording device 100 can be produced. At the same time, when the cartridges 50 and 60 are mounted on the carriage 30, the grip part 52 does not overlap the cartridge 60 and the grip part 62 does not overlap the cartridge 50 when viewed in the front-rear direction 8, thereby facilitating the replacement of the cartridges 50 and 60. Note that the cartridges 50 and 60 do not have to overlap in the front-rear direction 8 when mounted on the carriage 30 and may be positioned so as not to overlap at all in the front-rear direction 8.

In the preferred embodiment described above, the fixing pin 26 restricts movement of the carriage 30 when the carriage 30 is at the first position, thereby preventing movement of the carriage 30 when the cartridge 50 is inserted into or removed from the mounting unit 32. Accordingly, the fixing pin 26 can facilitate replacement of the cartridge 50. Similarly, the fixing pin 27 restricts movement of the carriage 30 when the carriage 30 is at the second position, thereby facilitating replacement of the cartridge 60. Note that while the drive force of the elevating motor 103 is transmitted to the fixing pins 26 and 27 for raising and lowering the same, a different method employing a solenoid valve or the like may be used instead for raising and lowering the fixing pins 26 and 27. Further, when not replacing the cartridge 50 or 60 (i.e., when the carriage 30 is at a position other than the first position and the second position), the openings 15A and 16A are respectively covered by the cover 15B and the cover 16B, thereby preventing dust, dripping water, and the like from entering the casing 10. However, the fixing pins 26 and 27 that fix the carriage 30 in the first position and the second position, respectively, and the covers 15B and 16B that cover the openings 15A and 16A may be omitted.

In the embodiment described above, the contact part 34 of the carriage 30 maintains the cover 15B at the first open position when the carriage 30 is at the first position, preventing the cover 15B from returning to the first closed position while the cartridge 50 is replaced, thereby facilitating replacement of the cartridge 50. Note that the contact part 34 may be provided on the cover 15B at a position for contacting the carriage 30 when the carriage 30 is at the first position. In other words, the contact part 34 may be provided on one of the carriage 30 and the cover 15B and positioned to contact the other when the carriage 30 is at the first position. The same is true with respect to the contact part 35. The contact parts 34 and 35 may also be omitted, particularly if the cover 15B and the cover 16B are eliminated.

In the embodiment described above, the controller 130 notifies a user that the carriage 30 cannot move (S12) when the carriage 30 has not reached the first position within the moving time (S2: YES). Through this notification, the controller 130 can prompt the user to eliminate whatever is interfering with movement of the carriage 30. Further, if the carriage 30 has been left at the first position for a long period of time, it is possible that the nozzles 31A exposed from the carriage 30 may become clogged with dried ink. Thus, if the cartridge 50 has not been removed from the mounting unit 32 within the removing time (S6: YES), if the cartridge 50 has not been mounted to the mounting unit 32 within the mounting time (S9: YES), or if the retry command has not been received within the retrying time (S13: YES), it is preferable to execute the capping process (S11), but this process may be omitted.

Note that it is not necessary for the controller 130 to receive a replacement command from a user to execute the cartridge-mounting process. For example, the controller 130 may execute the cartridge-mounting process when the quantity of ink stored in the cartridge 50 or 60 falls below a threshold value. Here, the inkjet recording device 100 may be provided with sensors for detecting the quantity of ink stored in each of the cartridges 50 and 60, or may identify the quantity of remaining ink by tracking the amount of ink ejected from the recording head 31. As another example, the controller 130 may execute the cartridge-mounting process when the cartridge 50 or 60 is not mounted to the corresponding mounting unit 32 or 33 when the power supply for the inkjet recording device 100 is turned on.

Further, the number of cartridges 50 and 60 mounted on the carriage 30 is not limited to the two described in the embodiment. For example, four cartridges storing ink in the colors black, cyan, magenta, and yellow may be mountable in the carriage 30. In this case, the grip parts of any two adjacent cartridges in the front-rear direction 8 preferably are offset in opposite directions from the distal openings 31B of the nozzles 31A in a plan view. Further, a single cartridge may be provided with a plurality of storage chambers and a plurality of ink supply parts to correspond with the plurality of ink colors. For example, one cartridge may store ink in the three colors cyan, magenta, and yellow, while another cartridge stores ink in the color black. Further, the liquid stored in a cartridge is not limited to ink, but may be a pretreatment liquid that is ejected onto the recording sheet 5 prior to the ink during a printing operation.

[Modification of the Embodiment]

Next, a modification of the carriage 30, maintenance mechanism 40, and cartridges 50 and 60 will be described with reference to FIGS. 10 and 12. Note that the following description focuses on the parts and components different from those of the preferred embodiment described above, while common parts and components will not be described in detail. In the following description, like parts and components have been designated with the same reference numerals as those used in the embodiment to avoid duplicating description.

The cartridges 50 and 60 according to the embodiment are not limited to having the same shape, but may be differently shaped in a cross section taken perpendicularly to the direction in which the cartridges 50 and 60 according to the embodiment are inserted into and removed from the corresponding mounting units 32 and 33 (i.e., the left-right direction 9).

Figure 10B:
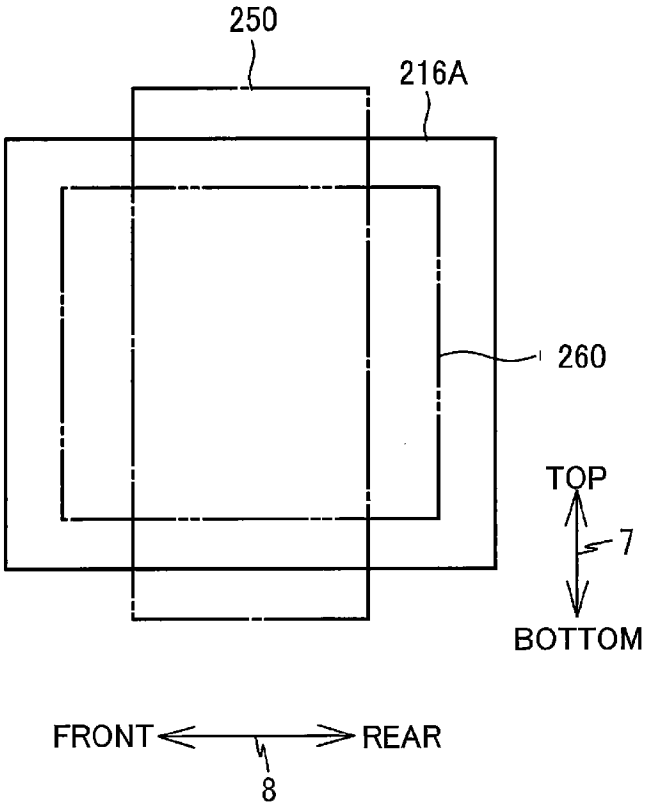
FIG. 10B is a schematic view illustrating a shape of a second opening and the cartridges as viewed from left-right direction according to the modification of the present invention.
Figure 10A:
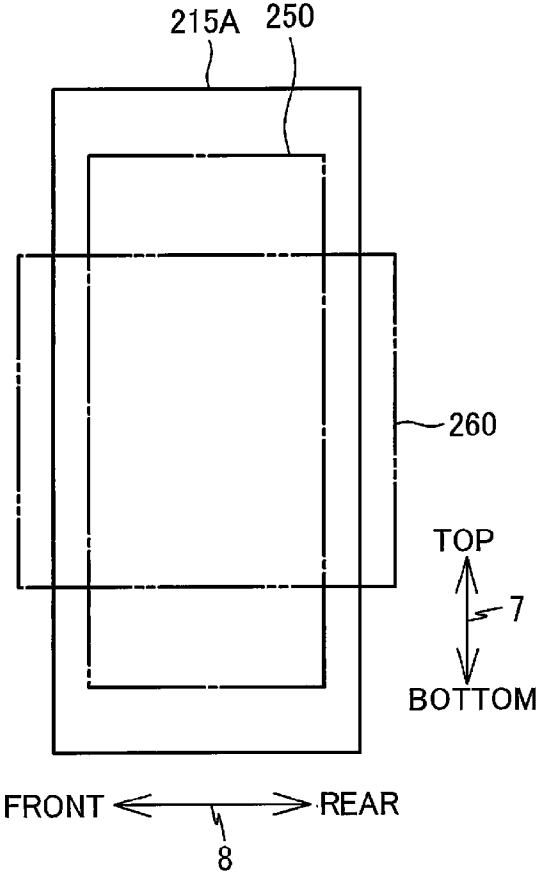
FIG. 10A is a schematic view illustrating a shape of a first opening and cartridges as viewed from left-right direction according to a modification of the present invention.

For example, as illustrated in FIGS. 10A and 10B, when cartridges 250 and 260 according to the modification are mounted on a carriage 230, the cartridge 250 has a first cross-section perpendicular to the left-right direction 9, and the first cross-section has a first cross-sectional shape. The cartridge 260 has a second cross-section perpendicular to the left-right direction 9, and the second cross-section has a second cross-sectional shape. The first cross-sectional shape is different from the second cross-sectional shape. More specifically, when the cartridges 250 and 260 are mounted on the carriage 230, the dimension of the cartridge 250 in the top-bottom direction 7 is greater than that of the cartridge 260 in the top-bottom direction 7, while the dimension of the cartridge 260 in the front-rear direction 8 is greater than that of the cartridge 250 in the front-rear direction 8.

When employing the shapes of the cartridges 250 and 260 described above, openings 215A (example of the first opening) and 216A (example of the second opening) formed at right and left walls 15 and 16 according to the modification are shaped differently as viewed from the left-right direction 9, i.e., from the leftward direction or rightward direction, to correspond to the first cross-sectional and second cross-sectional shapes of the cartridges 250 and 260. For example, the dimensions of the opening 215A in the top-bottom direction 7 and the front-rear direction 8 are greater than the same dimensions of the cartridge 250, as shown in FIG. 10A. However, the dimension of the opening 215A in the front-rear direction 8 is shorter than the same dimension of the cartridge 260. Similarly, the dimensions of the opening 216A in the top-bottom direction 7 and the front-rear direction 8 are greater than the same dimensions of the cartridge 260, as shown in FIG. 10B. However, the dimension of the opening 216A in the top-bottom direction 7 is shorter than the same dimension of the cartridge 250.

Therefore, the cartridge 250 can pass through the opening 215A but not through the opening 216A, while the cartridge 260 can pass through the opening 216A but not through the opening 215A. This configuration prevents the cartridges 250 and 260 from being mounted to wrong mounting units 32 and 33. Note that the shapes of the openings 215A and 216A and the cartridges 250 and 260 viewed from the left-right direction 9 are not limited to a square shape, but may be circular, elliptical, triangular, or another arbitrary shape.

Figure 11A:
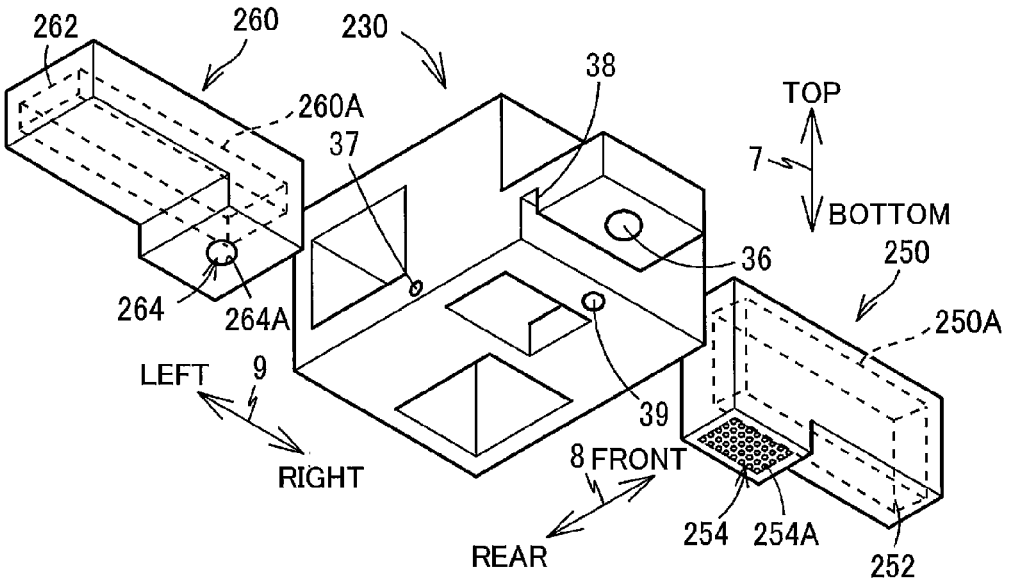
FIG. 11A is a perspective view of a carriage and cartridges wherein the cartridges are separated from mounting units of the carriage according to the modification of the invention.

As illustrated in FIG. 11A, the cartridge 250 according to the present modification includes a storage chamber 250A for storing ink as is described in the preferred embodiment. However, in place of the ink delivery part 53, the cartridge 250 is provided with a recording head having a plurality of nozzles 254 (example of the first flowing part) for flowing out ink stored in the cartridge 250. The nozzles 254 are formed with a plurality of first distal openings 254A. Further, the cartridge 250 according to this modification has a greater dimension than the cartridge 260 in the top-bottom direction 7 and a smaller dimension than the cartridge 260 in the front-rear direction 8, as described with reference to FIGS. 10A and 10B. When the cartridge 250 is mounted on a carriage 230, electrical contacts (not shown) provided on the cartridge 250 contact electrical contacts (not shown) provided in the carriage 230 to form an electrical connection between the controller 130 and the recording head of the cartridge 250 so that the controller 130 can drive the recording head of the cartridge 250.

On the other hand, the cartridge 260 according to the modification is configured to store ink that a maintenance mechanism 240 has drawn out of the cartridge 250. Further, in place of the ink delivery part 63, the cartridge 260 is provided with an inlet 264 (an example of the second flowing part) for flowing ink drawn out of the cartridge 250 by the maintenance mechanism 240 into the cartridge 260. The inlet 264 is formed with a second distal opening 264A. Further, the cartridge 260 includes a storage chamber 260A filled with an absorbent material capable of retaining ink. In other words, at least one of the cartridges 250 and 260 mounted on the carriage 230 need not store ink when initially mounted, provided that the cartridge is configured to store ink.

Figure 11B:
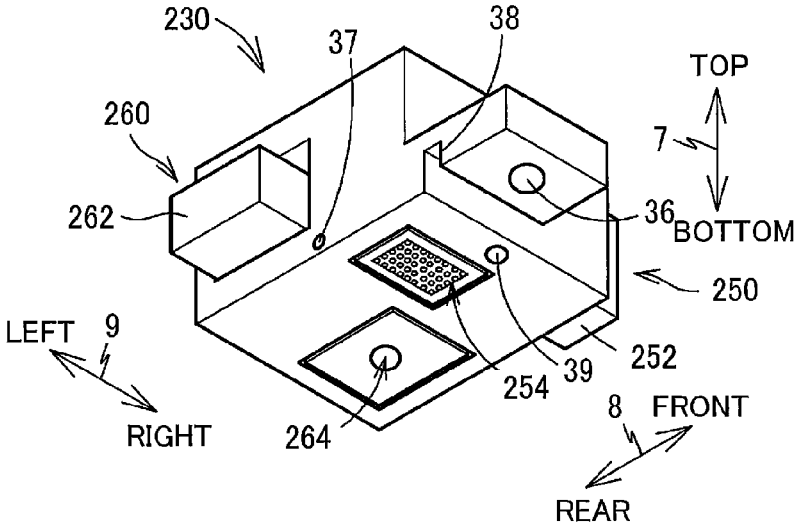
FIG. 11B is a perspective view of the carriage and the cartridges wherein the cartridges are mounted on the mounting units according to the modification of the invention.

As shown in FIG. 11B, similarly to the embodiment describe above, a grip part 252 of the cartridge 250 and a grip part 262 of the cartridge 260 are offset in opposite directions from the first and second distal openings 254A and 264A exposed from the carriage 230.

Further, the flowing parts of the present invention need only be configured to flow ink between the first and second distal openings 254A and 264A exposed from the carriage 230, and proximal openings (not shown) in fluid communication with the storage chambers 250A and 260A of the cartridges 250 and 260. The nozzles 254 according to the modification of the embodiment receive ink from the storage chamber 250A through the proximal opening and eject this ink through the first distal openings 254A. The inlet 264 according to the modification receives ink that flowed from the second distal opening 264A and supplies this ink to the storage chamber 260A through the proximal opening. The direction of ink flow along the top-bottom direction 7 is the downward direction through the first distal opening 254A of the nozzles 254 and the upward direction through the second distal opening 264A of the inlet 264.

Further, the carriage 230 according to the modification is not provided with the recording head 31. Thus, two openings are formed in the bottom surface of the carriage 230 before the cartridges 250 and 260 are mounted to the carriage 230, as illustrated in FIG. 11A. The nozzles 254 of the cartridge 250 and the inlet 264 of the cartridge 260 are respectively exposed from these two openings formed in the bottom surface of the carriage 230 when the cartridges 250 and 260 are mounted on the carriage 230, as illustrated in FIG. 11B. Hence, the flowing parts of the present invention need not be fixed to the carriage 230, but may be mounted on the carriage 230 in a state where the cartridges 250 and 260 are mounted on the carriage 230.

Figure 12:
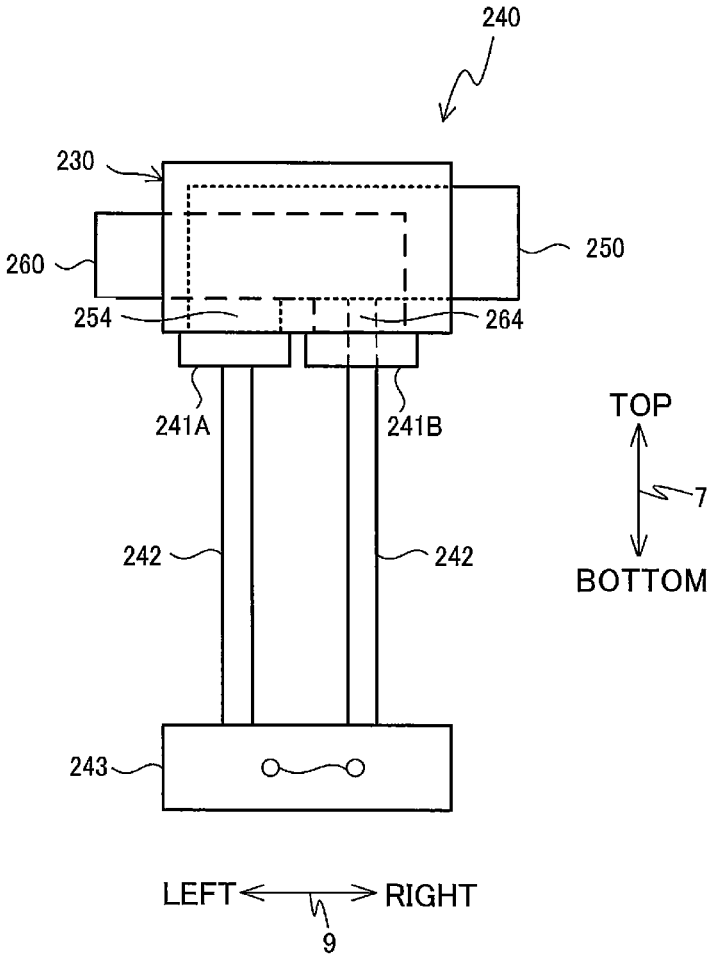
FIG. 12 is a schematic view of a maintenance mechanism according to the modification of the invention.

Further, as shown in FIG. 12, the maintenance mechanism 240 according to the present modification includes caps 241A and 241B as examples of the first and second caps. The cap 241A covers the first distal opening 254A of the nozzles 254 exposed from the carriage 230 when at the covering position, and the cap 241B covers the second distal opening 264A of the inlet 264 exposed from the carriage 230 when at the covering position. Further, a tube 242 has a first end connected to the cap 241A and a second end passing through the cap 241B and extending upward therefrom. When the cap 241B is at the covering position, the second end of the tube 242 is inserted into the inlet 264 of the cartridge 260. Note that the waste liquid tank 44 described in the preferred embodiment is omitted from the maintenance mechanism 240 according to the modification. By driving a pump 243 while the caps 241A and 241B are at the covering positions, the maintenance mechanism 240 having the above configuration draws ink from the nozzles 254 through the tube 242 and the inlet 264 to discharge the ink into the cartridge 260. Ink discharged into the cartridge 260 is retained by the absorbent material provided in the storage chamber 260A. In FIG. 12, parts corresponding to the contact parts 34 and 35 in the preferred embodiment are omitted.

Figure 13:
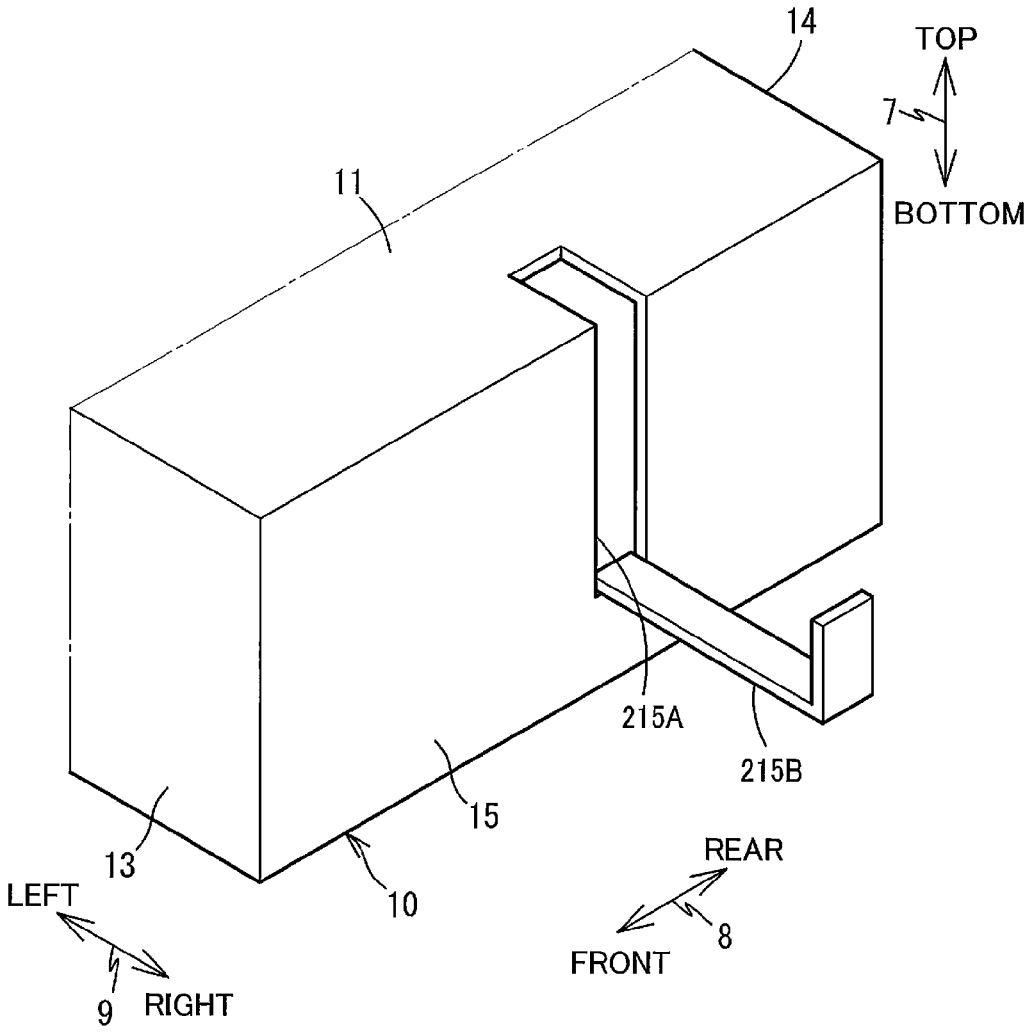
FIG. 13 is an outer perspective view of a casing wherein a cover is at an open position according to the modification of the invention.

As shown in FIG. 13, the first opening 215A according to the modification of the embodiment may be formed across the right wall 15 to the top wall 11. A cover 215B may be configured to move between a closed position and an open position by rotating about a rotational shaft (not shown) extending in the front-rear direction 8 along its bottom end. When the carriage 230 is moved to the first position, the cover 215B is contacted by the contact part 34 and moved to the first open position. In this state, the cartridge 250 may be mounted to and removed from the carriage 230 in the top-bottom direction 7 through the opening 215A extending into the top wall 11. Further, the direction in which the cartridge 250 is mounted to and removed from the carriage 230 need not be linear, but may be curved. The configuration of the opening 216A and the cover for covering the opening 216A and the mounting direction of the cartridge 260 are similar. Note that FIG. 13 does not show the internal components of the casing 10.

The configuration of the nozzles 254 and the inlet 264 respectively provided in the cartridges 250 and 260 in the above modification may be applied to the cartridges 50 and 60 in the preferred embodiment described earlier, and the configuration of the recording head 31 provided in the carriage 30 of the embodiment may be applied to the above modification. Similarly, the configuration of the opening 215A and the cover 215B shown in FIG. 13 may be applied to the preferred embodiment, while the configuration of the opening 15A and the cover 15B shown in FIGS. 1A and 1B may be applied to the modification. Further, the structural elements in the preferred embodiment and the modifications may be combined in various ways within the scope of the claims, without departing from the spirit of the invention.

What is claimed is:

1. A liquid ejecting device comprising:

a casing comprising a first wall formed with a first opening and a second wall formed with a second opening, at least part of the first wall being opposite to at least part of the second wall, the casing defining a first direction extending from the second wall to the first wall and a second direction opposite to the first direction;

a carriage configured to move in the first direction and the second direction in the casing;

a cartridge configured to be removably mounted on the carriage and comprising a first cartridge having a first storage chamber accommodating liquid therein and a second cartridge having a second storage chamber configured to accommodate liquid therein; and a flowing part configured to be mounted on the carriage in a state where the cartridge is mounted on the carriage, the flowing part comprising a first flowing part configured to flow liquid between at least one first distal opening exposed from the carriage and a first proximal opening in communication with the first storage chamber and a second flowing part configured to flow liquid between at least one second distal opening exposed from the carriage and a second proximal opening in communication with the second storage chamber, wherein the flowing part is configured to allow the liquid to pass through the at least one first distal opening and the at least one second distal opening in a third direction, wherein the first cartridge comprises a first mounting part at least partially overlapped with the at least one distal opening and/or the at least one second distal opening as viewed from the third direction and a first grip part offset from the at least one first distal opening and the at least one second distal opening in the first direction as viewed from the third direction, when the first cartridge is mounted on the carriage, wherein the second cartridge comprises a second mounting part at least partially overlapped with the at least one first distal opening and/or the at least one second distal opening as viewed from the third direction and a second grip part offset from the at least one first distal opening and the at least one second distal opening in the second direction as viewed from the third direction, when the second cartridge is mounted on the carriage, and wherein the carriage is configured to move between a first position where the first grip part is exposed and positioned outside the casing through the first opening and a second position where the second grip part is exposed and positioned outside the casing through the second opening.

2. The liquid ejecting device according to claim 1, further comprising:

a first restricting part configured to restrict a movement of the carriage in the second direction at the first position; and a second restricting part configured to restrict a movement of the carriage in the first direction at the second position.

3. The liquid ejecting device according to claim 1, wherein the cartridge is configured to be mounted to and removed from the carriage in the first direction and the second direction, wherein the first cartridge has a first cross-section perpendicular to the first direction and the second direction, and the first cross-section has a first cross-sectional shape, wherein the second cartridge has a second cross-section perpendicular to the first direction and the second direction, and the second cross-section has a second cross-sectional shape, wherein the first cross-sectional shape is different from the second cross-sectional shape, and wherein the first opening has a first shape as viewed from the second direction, the second opening has a second shape as viewed from the first direction, and the first shape is different from the second shape.

4. The liquid ejecting device according to claim 1, further comprising:

a position detecting unit configured to output a position signal for identifying a position of the carriage; and a controller configured to perform:

a movement control process to move the carriage to the first position or the second position; and a notification process to notify that the carriage is not capable of arriving at the first position or the second position if the position of the carriage identified by the position signal has not been the first position or the second position within a predefined moving time when the movement control process is performed.

5. The liquid ejecting device according to claim 4, further comprising:

a cap configured to move between a covering position at which the cap liquid-tightly covers the at least one first distal opening and the at least one second distal opening and a separated position at which the cap is separated from the at least one first distal opening and the at least one second distal opening, the cap being provided at a position facing the carriage positioned at a third position different from the first position and the second position; and a mounting/removing detection unit configured to output a mounting/removing signal indicating mounting of the cartridge to the carriage or removal of the cartridge from the carriage, wherein the controller is configured to perform a capping process to move the carriage to the third position and move the cap to the covering position if the mounting/removing detection unit does not output the mounting/removing signal within a predefined mounting/removing time when the carriage is at the first position or the second position.

6. The liquid ejecting device according to claim 5, wherein the cap comprises a first cap configured to cover the at least one first distal opening at the covering position and a second cap configured to cover the at least one second distal opening at the covering position, the liquid ejecting device further comprising:

a tube having a first end connected to the first cap and a second end connected to the second cap; and a pump configured to flow the liquid from the first end to the second end in the tube.

7. The liquid ejecting device according to claim 1, further comprising:

a first cover configured to move between a first closed position at which the first cover covers the first opening and the first opening is closed, and a first opening position at which the first cover does not cover the first opening and the first opening is opened; and a second cover configured to move between a second closed position at which the second cover covers the second opening and the second opening is closed, and a second opening position at which the second cover does not cover the second opening and the second opening is opened, wherein one of the carriage and the first cover has a first contact part configured to contact the other of the carriage and the first cover to move the first cover into the first opening position when the carriage is at the first position, and wherein one of the carriage and the second cover has a second contact part configured to contact the other of the carriage and the second cover to move the second cover into the second opening position when the carriage is at the second position.

8. The liquid ejecting device according to claim 1, wherein the first flowing part is formed in the first cartridge and the second flowing part is formed in the second cartridge, and wherein the at least one first distal opening is exposed from the carriage when the first cartridge is mounted on the carriage and the at least one second distal opening is exposed from the carriage when the second cartridge is mounted on the carriage.

9. The liquid ejecting device according to claim 1, wherein at least part of the first mounting part is overlapped with at least part of the second mounting part as viewed from a fourth direction perpendicular to the first direction, the second direction, and the third direction when the first cartridge and the second cartridge are mounted on the carriage.

10. The liquid ejecting device according to claim 1, wherein the first storage chamber accommodates therein liquid having a first color, the second storage chamber accommodates therein a liquid having a second color, and the first color is different from the second color.

11. A liquid ejecting device comprising:

a casing comprising a first wall formed with a first opening and a second wall formed with a second opening, at least part of the first wall being opposite to at least part of the second wall, the casing defining a first direction extending from the second wall to the first wall and a second direction opposite to the first direction;

a carriage configured to move in the first direction and the second direction within the casing; and a cartridge configured to be removably mounted on the carriage and comprising a first cartridge accommodating liquid therein and a second cartridge configured to accommodate liquid therein, wherein the first cartridge comprises a first grip part and the second cartridge comprises a second grip part, wherein the carriage is configured to move between a first position and a second position, wherein the first grip part is exposed and positioned outside the casing through the first opening and the second grip part is positioned inside the casing when the first cartridge and the second cartridge are mounted on the carriage at the first position, and wherein the second grip part is exposed and positioned outside the casing through the second opening and the first grip part is positioned inside the casing when the first cartridge and the second cartridge are mounted on the carriage at the second position.

12. The liquid ejecting device according to claim 11, further comprising:

a first restricting part configured to restrict a movement of the carriage in the second direction at the first position; and a second restricting part configured to restrict a movement of the carriage in the first direction at the second position.

13. The liquid ejecting device according to claim 11, wherein the cartridge is configured to be mounted to and removed from the carriage in the first direction and the second direction, wherein the first cartridge has a first cross-section perpendicular to the first direction and the second direction, and the first cross-section has a first cross-sectional shape, wherein the second cartridge has a second cross-section perpendicular to the first direction and the second direction, and the second cross-section has a second cross-sectional shape, wherein the first cross-sectional shape is different from the second cross-sectional shape, and wherein the first opening has a first shape as viewed from the second direction, the second opening has a second shape as viewed from the first direction, and the first shape is different from the second shape.

14. The liquid ejecting device according to claim 11, wherein the first cartridge comprises a first mounting part which is positioned between the first grip part and the second wall when the first cartridge is mounted on the carriage, wherein the second cartridge comprises a second mounting part which is positioned between the second grip part and the first wall when the second cartridge is mounted on the carriage, and wherein when the first cartridge and the second cartridge are mounted on the carriage, at least part of the first mounting part is overlapped with at least part of the second mounting part as viewed from a direction perpendicular to the first direction and the second direction.

15. The liquid ejecting device according claim 14, wherein when the first cartridge and the second cartridge are mounted on the carriage, the first grip part is offset from the second grip part in the first direction and is not overlapped with the second grip part as viewed from the direction perpendicular to the first direction and the second direction.

16. The liquid ejecting device according to claim 11, further comprising:

a position detecting unit configured to output a position signal for identifying a position of the carriage; and a controller configured to perform:

a movement control process to move the carriage to the first position or the second position; and a notification process to notify that the carriage is not capable of arriving at the first position or the second position if the position of the carriage identified by the position signal has not been the first position or the second position within a predefined moving time when the movement control process is performed.

17. The liquid ejecting device according to claim 16, further comprising:

a recording head mounted on the carriage;

a cap configured to move between a covering position at which the cap covers the recording head and a separated position at which the cap is separated from the recording head, the cap being provided at a position facing the carriage positioned at a third position different from the first position and the second position; and a mounting/removing detection unit configured to output a mounting/removing signal indicating mounting of the cartridge to the carriage or removal of the cartridge from the carriage, wherein the controller is configured to perform a capping process to move the carriage to the third position and move the cap to the covering position if the mounting/removing detection unit does not output the mounting/removing signal within a predefined mounting/removing time when the carriage is at the first position or the second position.

18. The liquid ejecting device according to claim 11, further comprising:

a first cover configured to move between a first closed position at which the first cover covers the first opening and the first opening is closed, and a first opening position at which the first cover does not cover the first opening and the first opening is opened; and a second cover configured to move between a second closed position at which the second cover covers the second opening and the second opening is closed, and a second opening position at which the second cover does not cover the second opening and the second opening is opened, wherein one of the carriage and the first cover has a first contact part configured to contact the other of the carriage and the first cover to move the first cover into the first opening position when the carriage is at the first position, and wherein one of the carriage and the second cover has a second contact part configured to contact the other of the carriage and the second cover to move the second cover into the second opening position when the carriage is at the second position.

* * * * *